US009978305B2

(12) United States Patent
In et al.

(10) Patent No.: US 9,978,305 B2
(45) Date of Patent: May 22, 2018

(54) ORGANIC LIGHT EMITTING DISPLAY UTILIZING DATA DRIVERS FOR SEQUENTIALLY SUPPLYING DATA SIGNALS TO OUTPUT LINES DURING ONE HORIZONTAL PERIOD

(71) Applicant: Samsung Display Co., Ltd., Yongin, Gyeonggi-do (KR)

(72) Inventors: Hai-Jung In, Yongin (KR); Yong-Sung Park, Yongin (KR); Bo-Yong Chung, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 26 days.

(21) Appl. No.: 14/604,624

(22) Filed: Jan. 23, 2015

(65) Prior Publication Data

US 2015/0243209 A1 Aug. 27, 2015

(30) Foreign Application Priority Data

Feb. 24, 2014 (KR) ..... 10-2014-0021190

(51) Int. Cl.
*G09G 3/30* (2006.01)
*G09G 3/3208* (2016.01)
(Continued)

(52) U.S. Cl.
CPC ..... *G09G 3/3208* (2013.01); *G09G 3/3275* (2013.01); *G09G 3/2022* (2013.01);
(Continued)

(58) Field of Classification Search
CPC .. G09G 3/12; G09G 3/14; G09G 3/30–3/3291
See application file for complete search history.

(56) References Cited

U.S. PATENT DOCUMENTS

2004/0090400 A1 5/2004 Yoo
2007/0242016 A1* 10/2007 Choi ..... G09G 3/3233 345/92

(Continued)

FOREIGN PATENT DOCUMENTS

KR 10-2004-0039934 A 5/2004
KR 10-2005-0003753 A 1/2005

(Continued)

*Primary Examiner* — Sanghyuk Park
(74) *Attorney, Agent, or Firm* — Lewis Roca Rothgerber Christie LLP

(57) ABSTRACT

An organic light emitting display can improve display quality by securing a charging time of a data signal. An organic light emitting display includes pixels, a data driver, a plurality of data drivers, and a control signal generator. The pixels are respectively positioned at areas defined by scan lines and data lines. The data driver sequentially supplies i (i is a natural number greater than or equal to 2) data signals to each of output lines during one horizontal period. The plurality of data dividers are respectively coupled to the output lines, and supply the i data signals to i data lines. The control signal generator sequentially supplies i control signals to the data dividers, corresponding to the i data signals. In the organic light emitting display, the data dividers supply a corresponding data signal to each data line during the one horizontal period.

17 Claims, 13 Drawing Sheets

(51) Int. Cl.
*G09G 3/3275* (2016.01)
*G09G 3/20* (2006.01)

(52) U.S. Cl.
CPC . *G09G 2310/0297* (2013.01); *G09G 2310/08* (2013.01); *G09G 2320/0223* (2013.01)

(56) References Cited

U.S. PATENT DOCUMENTS

| | | | | |
|---|---|---|---|---|
| 2008/0055304 | A1 | 3/2008 | Ryu et al. | |
| 2008/0170008 | A1 | 7/2008 | Kim | |
| 2009/0207104 | A1 | 8/2009 | Lee | |
| 2009/0207110 | A1* | 8/2009 | Lee | G09G 3/2022 345/82 |
| 2010/0117939 | A1 | 5/2010 | Lee | |
| 2013/0141320 | A1 | 6/2013 | Kim | |

FOREIGN PATENT DOCUMENTS

| | | | |
|---|---|---|---|
| KR | 10-2008-0067488 | A | 7/2008 |
| KR | 10-2009-0090117 | A | 8/2009 |
| KR | 10-2010-0051253 | A | 5/2010 |
| KR | 10-2012-0130901 | A | 12/2012 |
| KR | 10-2013-0061884 | A | 6/2013 |

* cited by examiner

ORGANIC LIGHT EMITTING DISPLAY UTILIZING DATA DRIVERS FOR SEQUENTIALLY SUPPLYING DATA SIGNALS TO OUTPUT LINES DURING ONE HORIZONTAL PERIOD

CROSS REFERENCE TO RELATED APPLICATION

This application claims priority to and the benefit of Korean Patent Application No. 10-2014-0021190, filed on Feb. 24, 2014, in the Korean Intellectual Property Office, the entire content of which is incorporated herein by reference in its entirety.

BACKGROUND

1. Field

An aspect of the present invention relates to an organic light emitting display.

2. Description of the Related Art

With the development of information technologies, the importance of a display device which is a connection medium between a user and information increases. Accordingly, flat panel displays (FPDs) such as a liquid crystal display (LCD), an organic light emitting display (OLED display) and a plasma display panel (PDP) are increasingly used.

Among these FPDs, the OLED display displays images using organic light emitting diodes that emit light through recombination of electrons and holes. The OLED display has a fast response speed and is driven with low power consumption.

SUMMARY

Embodiments of the present invention provide an organic light emitting display which can improve display quality by securing a charging time of a data signal.

According to an aspect of embodiments according to the present invention, there is provided an organic light emitting display, including: pixels at areas defined by scan lines and data lines; a data driver configured to sequentially supply i (i is a natural number greater than or equal to 2) data signals to each of output lines during one horizontal period; a plurality of data dividers respectively coupled to the output lines, the plurality of data dividers for supplying the i data signals to i data lines from among the data lines; and a control signal generator configured to sequentially supply i control signals to the data dividers, corresponding to the i data signals, wherein the data dividers are configured to supply a corresponding one of the data signals to each of the data lines during the one horizontal period.

The data driver may reverse or may not reverse a first data signal corresponding to emission of the pixel or a second data signal corresponding to non-emission of the pixel, and to supply the first or second data signal as the one of the data signals.

The data divider may include i division units respectively coupled to the i data lines. The division unit may include a second division unit for receiving an i-th data signal in the one horizontal period, and one or more first division units for receiving the other data signals except the i-th data signal in the one horizontal period, the first division unit being configured with a circuit different from that of the second division unit.

Each first division unit may include an output unit configured to supply a voltage of a first or second power source to an output terminal coupled to a corresponding one of the data lines, corresponding to voltages of first and second nodes; a first driver coupled to a second input terminal, the first driver for controlling the coupling between the output unit and the first and second nodes; a second driver coupled to the first power source and a third power source, the second driver for controlling the voltage of the first node, corresponding to a first input terminal, the second input terminal and a third node; a third driver coupled to the first and third power sources, the third driver for controlling a voltage of the third node, corresponding to an output line, the first input terminal and a third input terminal; and a fourth driver coupled to the first and third power sources, the fourth driver for controlling the voltage of the second node, corresponding to the output line, the first input terminal and the second input terminal.

A control signal overlapped with a data signal may be supplied to the first input terminal, a control signal overlapped with the i-th data signal may be supplied to the second input terminal, and a control signal supplied prior to the control signal supplied to the first input terminal may be supplied to the third input terminal.

The output unit may include a first transistor coupled between the first power source and the output terminal, the first transistor having a gate electrode coupled to the first node via the first driver; a second transistor coupled between the output terminal and the second power source, the second transistor having a gate electrode coupled to the second node via the first driver; a first capacitor coupled between the first power source and the gate electrode of the first transistor; and a second capacitor coupled between the output terminal and the gate electrode of the second transistor.

The second driver may include a fifth transistor coupled between the first power source and a sixth transistor, the fifth transistor having a gate electrode coupled to the second input terminal; the sixth transistor coupled between the fifth transistor and the first node, the sixth transistor having a gate electrode coupled to a fourth node; a seventh transistor coupled between the first node and the third power source, the seventh transistor having a gate electrode coupled to the first input terminal; an eighth transistor coupled between the third and fourth nodes, the eighth transistor having a gate electrode coupled to the first input terminal; a third capacitor coupled between the first power source and the fourth node; and a fourth capacitor coupled between the first node and the third power source, the fourth capacitor having a capacity higher than that of the first capacitor.

The third driver may include a ninth transistor coupled between the first power source and the third node, the ninth transistor having a gate electrode coupled to a fifth node; a tenth transistor coupled between the third node and the third power source, the tenth transistor having a gate electrode coupled to the third input terminal; an eleventh transistor coupled between the first power source and the fifth node, the eleventh transistor having a gate electrode coupled to the third input terminal; a twelfth transistor coupled between the output line and the fifth node, the twelfth transistor having a gate electrode coupled to the first input terminal; a fifth capacitor coupled between the third node and the third power source, the fifth capacitor having a capacity higher than that of the third capacitor; and a sixth capacitor coupled between the first power source and the fifth node.

The first driver may include a third transistor coupled between the first node and a gate electrode of the first transistor, the third transistor having a gate electrode coupled to the second input terminal; and a fourth transistor coupled between the second node and the gate electrode of the second transistor, the fourth transistor having a gate electrode coupled to the second input terminal.

The fourth driver may include a thirteenth transistor coupled between the first power source and a fourteenth transistor, the thirteenth transistor having a gate electrode coupled to the second input terminal; the fourteenth transistor coupled between the thirteenth transistor and the second node, the fourteenth transistor having a gate electrode coupled to a sixth node; a fifteenth transistor coupled between the second node and the third power source, the fifteenth transistor having a gate electrode coupled to the first input terminal; a sixteenth transistor coupled between the output line and the sixth node, the sixteenth transistor having a gate electrode coupled to the first input terminal; a seventh capacitor coupled between the second node and the third power source, the seventh capacitor having a capacity higher than that of the second capacitor; and an eighth capacitor coupled between the first power source and the sixth node.

The second division unit may include an output unit configured to supply a voltage of a first or second power source to an output terminal coupled to one of the data lines, corresponding to voltages of first and second nodes; a first driver coupled to a second input terminal, the first driver controlling the coupling between the output unit and the first and second nodes; and a second driver coupled to the first power source and a third power source, the second driver for controlling the voltages of the first and second nodes, corresponding to an output line, a first input terminal and the second input terminal.

A control signal overlapped with a data signal may be supplied to the second input terminal, and a control signal supplied prior to the control signal supplied to the second input terminal may be supplied to the first input terminal.

The output unit may include a first transistor coupled between the first power source and the output terminal, the first transistor having a gate electrode coupled to the first node via the first driver; a second transistor coupled between the output terminal and the second power source, the second transistor having a gate electrode coupled to the second node via the first driver; a first capacitor coupled between the first power source and the gate electrode of the first transistor; and a second capacitor coupled between the output terminal and the gate electrode of the second transistor.

The second driver may include a fifth transistor coupled between the first power source and the second node, the fifth transistor having a gate electrode coupled to the first node; a sixth transistor coupled between the second node and the third power source, the sixth transistor having a gate electrode coupled to the first input terminal; a seventh transistor coupled between the first power source and the first node, the seventh transistor having a gate electrode coupled to the first input terminal; an eighth transistor coupled between the output line and the first node, the eighth transistor having a gate electrode coupled to the second input terminal; a third capacitor coupled between the second node and the third power source, the third capacitor having a capacity higher than that of the second capacitor; and a fourth capacitor coupled between the first power source and the first node.

The first driver may include a third transistor coupled between the first node and a gate electrode of the first transistor, the third transistor having a gate electrode coupled to the second input terminal; and a fourth transistor coupled between the second node and the gate electrode of the second transistor, the fourth transistor having a gate electrode coupled to the second input terminal.

The first division unit may include an output unit configured to supply a voltage of a first power source or a second power source set to a voltage lower than that of the first power source to an output terminal coupled to one of the data lines, corresponding to a voltage of a first node; a second driver configured to output the voltage of the first or second power source, corresponding to a voltage of a second node; a first driver coupled to first and second input terminals, the first driver controlling the coupling between the second driver and the first node; and a third driver coupled to the first and second input terminals, the third driver for controlling the coupling between an output line and the second node.

A first control signal may be supplied to the first input terminal, and a second control signal having a phase reversed with respect to the first control signal may be supplied to the second input terminal.

The output unit may include a first PMOS transistor coupled between the first power source and the output terminal, the first PMOS transistor having a gate electrode coupled to the first node; a second NMOS transistor coupled between the output terminal and the second power source, the second NMOS transistor having a gate electrode coupled to the first node; and a first capacitor coupled between the first node and the second power source. The first driver may include a third PMOS transistor coupled between the second driver and the first node, the third PMOS transistor having a gate electrode coupled to the second input terminal; and a fourth NMOS transistor coupled between the second driver and the first node, the fourth NMOS transistor having a gate electrode coupled to the first input terminal. The second driver may include a fifth PMOS transistor coupled between the first power source and the first driver, the fifth PMOS transistor having a gate electrode coupled to the second node; a sixth NMOS transistor coupled between the first driver and the second power source, the sixth NMOS transistor having a gate electrode coupled to the second node; and a second capacitor coupled between the second node and the second power source. The third driver may include a seventh PMOS transistor coupled between the output line and the second node, the seventh PMOS transistor having a gate electrode coupled to the first input terminal; and an eighth NMOS transistor coupled between the output line and the second node, the eighth NMOS transistor having a gate electrode coupled to the second input terminal.

The second division unit may include an output unit configured to supply a voltage of a first power source or a second power source set to a voltage lower than that of the first power source to an output terminal coupled to one of the data lines, corresponding to a voltage of a first node; a first driver configured to supply the voltage of the first or second power source to the first node, corresponding to a voltage of a second node; and a second driver coupled between first and second input terminals, the second driver controlling the coupling between an output line and the second node.

The output unit may include a first PMOS transistor coupled between the first power source and the output terminal, the first PMOS transistor having a gate electrode coupled to the first node; and a second NMOS transistor coupled between the output terminal and the second power source, the second NMOS transistor having a gate electrode coupled to the first node. The first driver may include a fifth PMOS transistor coupled between the first power source and the first node, the fifth PMOS transistor having a gate electrode coupled to the second node; a sixth NMOS transistor coupled between the first node and the second power source, the sixth NMOS transistor having a gate electrode coupled to the second node; and a second capacitor coupled between the second node and the second power source. The second driver may include a seventh PMOS transistor coupled between the output line and the second node, the seventh PMOS transistor having a gate electrode coupled to the first input terminal; and an eighth NMOS transistor coupled between the output line and the second node, the eighth NMOS transistor having a gate electrode coupled to the second input terminal.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
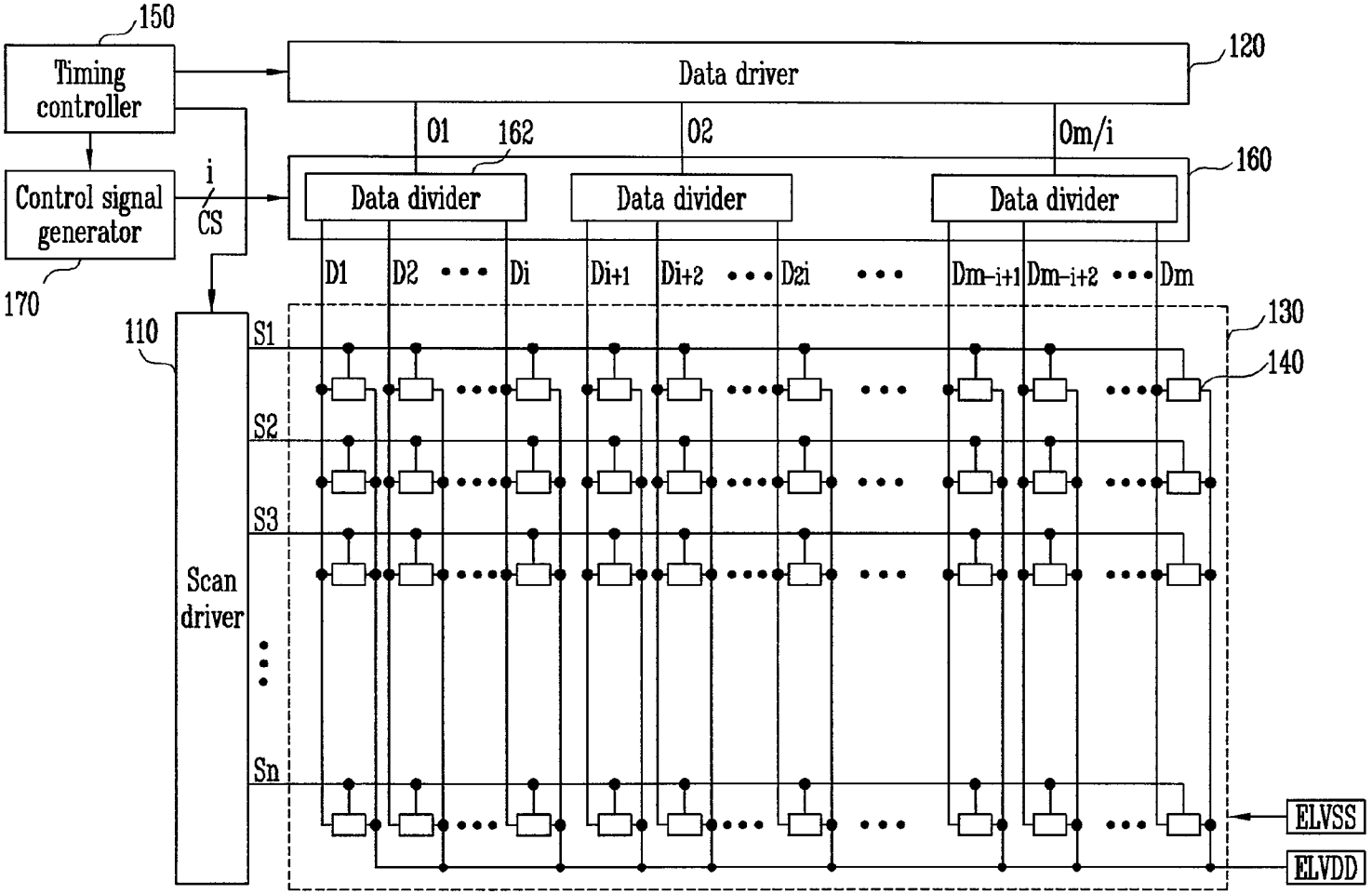
FIG. 1 is a diagram illustrating an organic light emitting display according to an embodiment of the present invention.

Hereinafter, certain example embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention may be omitted for clarity. Also, like reference numerals refer to like elements throughout.

FIG. 1 is a diagram illustrating an organic light emitting display according to an embodiment of the present invention.

Referring to FIG. 1, the organic light emitting display according to this embodiment includes a display unit 130 including pixels 140 respectively positioned at areas defined by scan lines S1 to Sn and data lines D1 to Dm, a scan driver 110 configured to supply scan signals to the scan lines S1 to Sn, and a data driver 120 configured to supply a plurality of data signals to output lines O1 to Om/i.

The organic light emitting display further includes a data divider unit 160 configured to transmit, to the data lines D1 to Dm, the plurality of data signals supplied to the output lines O1 to Om/i, a control signal generator 170 configured to generate a control signal CS and supply the generated control signal CS to the data divider unit 160, and a timing controller 150 configured to control the scan driver 110, the data driver 120 and the control signal generator 170.

The timing controller 150 controls driving timings of the scan driver 110, the data driver 120 and the control signal generator 170, corresponding to synchronization signals supplied from outside thereof (e.g., from outside of the timing controller 150). The timing controller 150 transmits data supplied from the outside to the data driver 120. Here, the timing controller 150 may store a data in a storage unit, corresponding to a driving method, and supply the stored data to the data driver 120.

The scan driver 110 supplies scan signals to the scan lines S1 to Sn during subframe periods included in one frame period. Here, the scan driver 110 sequentially or non-sequentially supplies the scan signals to the scan lines S1 to Sn, corresponding to the driving method. When the scan signal is supplied to any one scan line among the scan lines S1 to Sn, pixels 140 positioned at a corresponding horizontal line are selected.

The data driver 120 sequentially supplies a plurality of data signals to the output lines O1 to Om/i every horizontal period. For example, the data driver 120 may sequentially supply i (i is a natural number of 2 or more) data signals to each of the output lines O1 to Om/i every horizontal line. Here, the data driver 120 supplies a first data signal corresponding to the emission of the pixel 140 and/or a second data signal corresponding to the non-emission of the pixel 140 as a data signal, corresponding to a digital driving method.

The data divider unit 160 concurrently (e.g., simultaneously) supplies, to the data lines D1 to Dm, the data signals supplied to the output lines O1 to Om/i during a period wider (e.g., longer) than an H/i period, e.g., one horizontal period 1H. To this end, the data divider unit 160 includes a plurality of data dividers 162 respectively coupled to the output lines O1 to Om/i. The data divider 162 transmits, to i data lines, the i data signals supplied to an output line O every horizontal period. Here, the data divider 162 supplies a data signal to each of the i data lines during one horizontal period 1H.

In other words, the data divider 162 temporarily stores at least one of the plurality of data signals sequentially supplied to the output line O during the H/i period. After the i data signals are all supplied to the output line O, the data divider 162 concurrently (e.g., simultaneously) supplies the data signals to the i data lines coupled thereto during one horizontal period 1H. That is, in example embodiments of the present invention, the data signals time-divisionally supplied from the data driver during the horizontal period may be supplied to each of the data lines D1 to Dm during one horizontal period 1H, using the data divider 162, and accordingly, it is possible to reduce manufacturing cost and to improve display quality. The configuration and operation of the data driver 162 will be described in detail later.

The control signal generator 170 generates i control signals, and supplies the generated control signals to each data divider 162. The data divider 162 stores data signals, corresponding to first to (i−1)-th control signals, and concurrently (e.g., simultaneously) supplies the data signals to the data lines D1 to Dm, corresponding to an i-th control signal. For example, when the i is set to 4, the data divider 162 stores data signals, corresponding to first to third control signals, and concurrently (e.g., simultaneously) supplies the data signals to the data lines D1 to Dm, corresponding to a fourth control signal. Meanwhile, in FIG. 1, the control signal generator 170 is formed as a separate component, but the present invention is not limited thereto. For example, the control signal generator 170 may be formed inside the timing controller 150.

The display unit 130 receives first and second power sources ELVDD and ELVSS supplied from outside thereof, and supplies the first and second power sources ELVDD and ELVSS to each pixel 140. Each pixel 140 supplies current to an organic light emitting diode, corresponding to the data signal (emission), or implements a gray level (e.g., a predetermined gray level) while supplying no current (non-emission). That is, the pixels 140 implement gray levels, utilizing an emission time of one frame period. Additionally, in example embodiments of the present invention, the pixel 140 may be implemented with any one circuit among various types of circuits currently known to those skilled in the art, corresponding to the digital driving method.

In example embodiments of the present invention, the data driver 120 may reverse a data signal and supply the reversed data signal, corresponding to the circuit structure of the data divider 162. For example, when the first data signal is supplied to the pixel 140, the data driver 120 may output the second data signal by reversing the first data signal. The second data signal output from the data driver 120 is reversed as the first data signal in the data divider 162, to be supplied to the pixel 140.

The data driver 120 does not reverse the data signal but may supply the data signal as it is, corresponding to the circuit structure of the data divider 162. In this case, the data divider 162 does not reverse the data signal supplied from the data driver 120 but supplies the data signal to the pixel 140. This will be described in detail later.

Figure 2A:
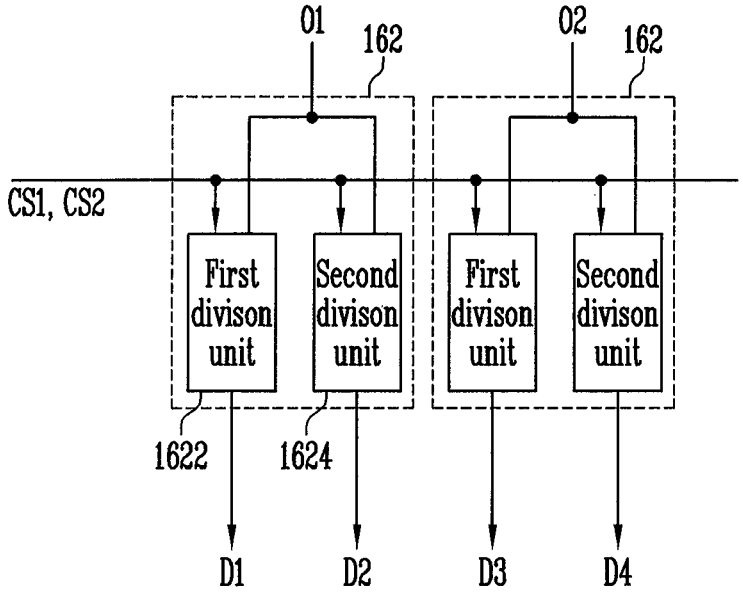
FIGS. 2A to 2C are diagrams illustrating embodiments of a data divider.
Figure 2B:
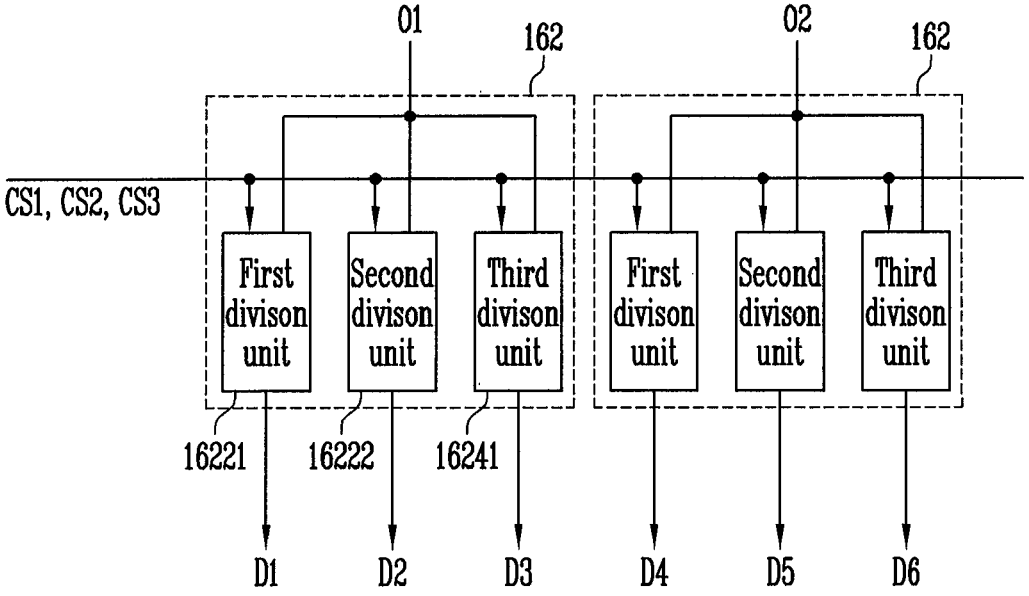
Figure 2C:
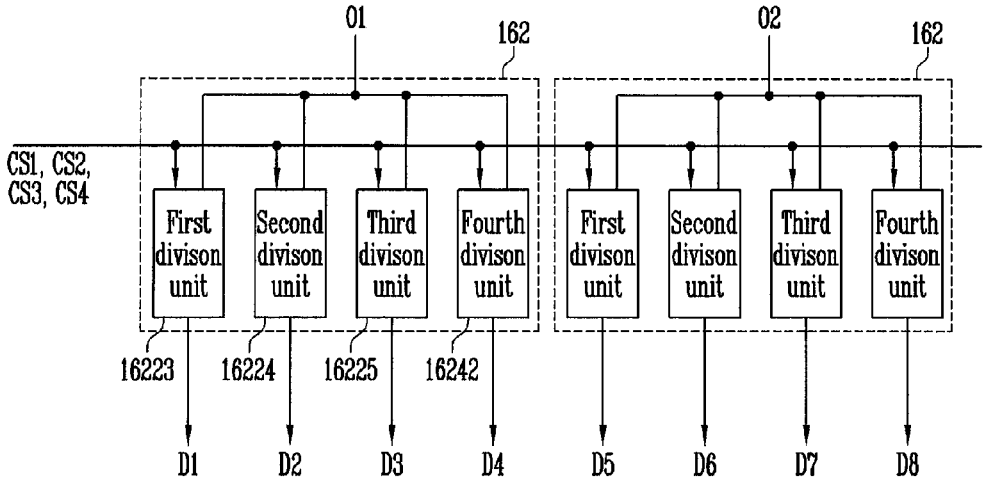

FIGS. 2A to 2C are diagrams illustrating embodiments of a data divider. Hereinafter, the data divider 162 coupled to a first output line O1 will be primarily described.

FIG. 2A illustrates a case where the data divider 162 is coupled to two data lines D1 and D2 (i.e., i=2). To this end, the data divider 162 includes first and second division units 1622 and 1624 to be respectively coupled to the data lines D1 and D2. The first division unit 1622 supplies a data signal from the first output line O1 to a first data line D1, corresponding to first and second control signals CS1 and CS2. The second division unit 1624 supplies the data signal from the first output line O1 to a second data line D2, corresponding to the first and second data signals CS1 and CS2. As such, the first and second division units 1622 and 1624 supply the data signal to the data lines D1 and D2 during one horizontal period 1H.

Here, the first division unit 1622 stores the data signal from the first output line O1, and supplies the stored data signal to the first data line D1. The second division unit 1624 supplies the data signal from the first output line O1 to the second data line D2 from a supply time. That is, the driving processes of the first and second division units 1622 and 1624 are different from each other, and accordingly, the first and second division units 1622 and 1624 are implemented with different circuits from each other. Additionally, the first and second division units 1622 and 1624 reverse the data signal and output the reversed data signal. Alternatively, the first and second division units 1622 and 1624 do not reverse the data signal but output the data signal as it is.

FIG. 2B illustrates a case where the data divider 162 is coupled to three data lines D1 to D3 (i.e., i=3). To this end, the data divider 162 includes first, second and third division units 16221, 16222 and 16241 to be respectively coupled to the data lines D1 to D3. The first division unit 16221 supplies a data signal from the first output line O1 to a first data line D1, corresponding to the first control signal CS1, a second control signal CS2 and the third control signal CS3. The second division unit 16222 supplies the data signal from the first output line O1 to a second data line D2, corresponding to first to third control signals CS1 to CS3. The third division unit 16241 supplies the data signal from the first output line O1 to a third data line D3, corresponding to the second and third control signals CS2 and CS3. The first, second and third division units 16221, 16222 and 16241 supply the data signals to the data lines D1 to D3 during one horizontal period 1H.

Here, the first and second division units 16221 and 16222 storing the data signal and then outputting the stored data signal are implemented with the same circuit, and the third division unit 16241 outputting the data signal at a supply time is implemented with a circuit different from that of the first division unit 16221. For example, the first and second division units 16221 and 16222 of FIG. 2B are implemented with the same circuit as that of the second division unit 1624 of FIG. 2A. Additionally, the first, second and third division units 16221, 16222 and 16241 reverse the data signal and output the reversed data signal. Alternatively, in other embodiments, the first, second and third division units 16221, 16222 and 16241 may not reverse the data signal but may output the data signal as it is.

FIG. 2C illustrates a case where the data divider 162 is coupled to four data lines D1 to D4 (i.e., i=4). To this end, the data divider 162 includes first, second, third and fourth division units 16223, 16224, 16225 and 16242 to be respectively coupled to the data lines D1 to D4. The first division unit 16223 supplies a data signal from the first output line O1 to a first data line D1, corresponding to first and fourth control signals CS1 and CS4. The second division unit 16224 supplies the data signal from the first output line O1 to a second data line D2, corresponding to the first control signal CS1, a second control signal CS2 and the fourth control signal CS4. The third division unit 16225 supplies the data signal from the first output line O1 to a third data line D3, corresponding to the second control signal CS2, a third control signal CS3 and the fourth control signal CS4. The fourth division unit 16242 supplies the data signal from the first output line O1 to a fourth data line D4, corresponding to the third and fourth control signals CS3 and CS4. The first, second, third and fourth division units 16223, 16224, 16225 and 16242 supply the data signals to the data lines D1 to D4 during one horizontal period 1H.

Here, the first to third division units 16223 to 16225 storing the data signal and outputting the stored data signal are implemented with the same circuit, and the fourth division unit 16242 outputting the data signal from a supply time is implemented with a circuit different from that of the first division unit 16223. For example, the first to third division units 16223 to 16225 of FIG. 2C are implemented with the same circuit as that of the first division unit 1622 of FIG. 2A, and the fourth division unit 16242 of FIG. 2C is implemented with the same circuit as that of the second division unit 1624 of FIG. 2A.

In example embodiments of the present invention, the division unit finally receiving the data signal supplied from the first output line O1 is implemented with a circuit different from that of the other division units. Additionally, the first, second, third and fourth division units 16223, 16224, 16225 and 16242 reverse the data signal and output the reversed data signal. Alternatively, in other embodiments, the first, second, third and fourth division units 16223, 16224, 16225 and 16242 may not reverse the data signal but may output the data signal as it is.

Figure 3:
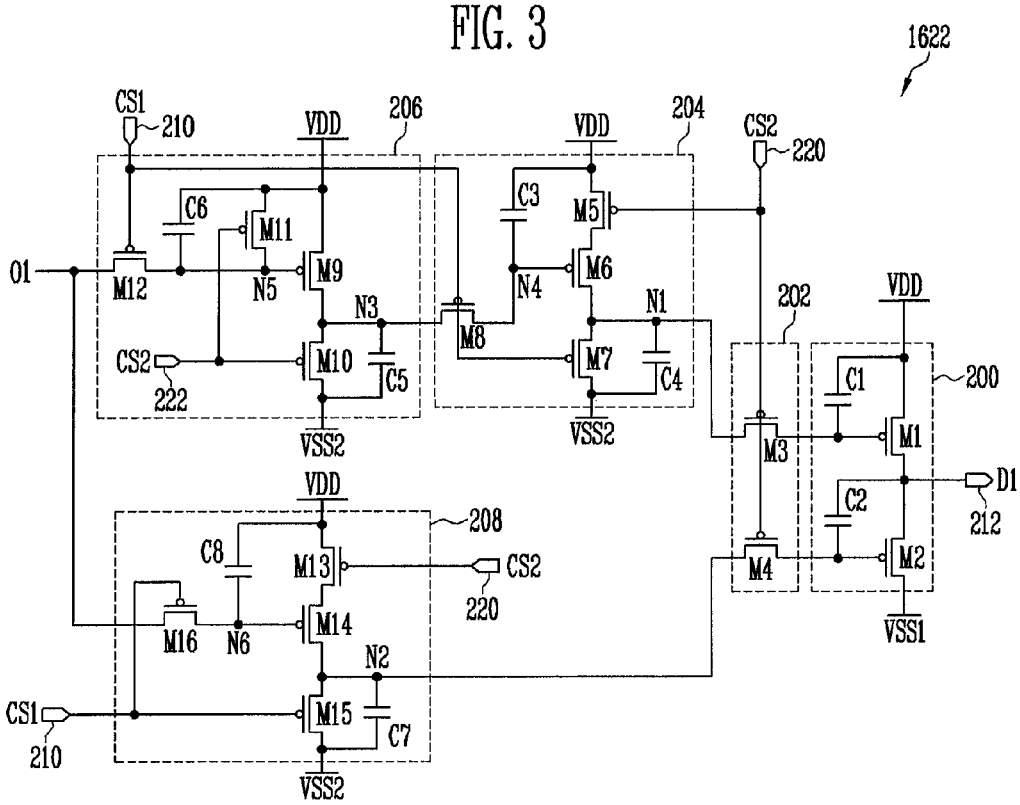
FIG. 3 is a circuit diagram illustrating an embodiment of a first division unit shown in FIG. 2A.

FIG. 3 is a circuit diagram illustrating an embodiment of the first division unit shown in FIG. 2A. For convenience of illustration, the first division unit 1622 coupled to the first data line D1 will be shown in FIG. 3. In FIG. 3, the first division unit 1622 is configured using only PMOS transistors so as to be easily mounted corresponding to the pixels 140 formed with the PMOS transistors.

Referring to FIG. 3, the first division unit 1622 according to this embodiment includes an output unit 200, a first driver 202, a second driver 204, a third driver 206 and a fourth driver 208.

The output unit 200 outputs the voltage of first or second power source VDD or VSS1 as a data signal, corresponding to voltages of first and second nodes N1 and N2. The first driver 202 controls the coupling between the output unit 200 and the first and second nodes N1 and N2. The fourth driver 208 controls the voltage of the second node N2, corresponding to a voltage of the first output line O1. The second driver 204 controls the voltage of the first node N1, corresponding to a voltage of a third node N3.

Here, the second and fourth drivers 204 and 208 are implemented with the same circuit. That is, the second and fourth drivers 204 and 208 control the voltages of the first and second nodes N1 and N2, corresponding to voltages supplied thereto. The third driver 206 controls the voltage of the third node N3, corresponding to the data signal supplied to the first output line O1.

The output unit 200 supplies the voltage of the first or second power source VDD or VSS1 to an output terminal 212, corresponding to the voltages of the first and second nodes N1 and N2. Here, the first power source VDD is set to a voltage higher than that of the second power source VSS1. For example, the first power source VDD may be supplied as a second data signal to the pixel 140, and the second power source VSS1 may be supplied as a first data signal to the pixel 140. The first or second power source VDD or VSS1 supplied to the output terminal 212 is supplied as a data signal to the first data line D1.

The output unit 200 includes a first transistor M1, a second transistor M2, a first capacitor C1 and a second capacitor C2. The first transistor M1 is coupled between the first power source VDD and the output terminal 212. A gate electrode of the first transistor M1 is coupled to the first node N1 via the first driver 202. The first transistor M1 controls the electrical coupling between the first power source VDD and the output terminal 212, corresponding to a voltage supplied to the gate electrode thereof.

The second transistor M2 is coupled between the output terminal 212 and the second power source VSS1. A gate electrode of the second transistor M2 is coupled to the second node N2 via the first driver 202. The second transistor M2 controls the electrical coupling between the second power source VSS1 and the output terminal 212, corresponding to a voltage supplied to the gate electrode thereof.

The first capacitor C1 is coupled between the first power source VDD and the gate electrode of the first transistor M1. The first capacitor C1 stores a voltage corresponding to the turn-on or turn-off of the first transistor M1.

The second capacitor C2 is coupled between the output terminal 212 and the gate electrode of the second transistor M2. The second capacitor C2 stores a voltage corresponding to the turn-on or turn-off of the first transistor M1.

The first driver 202 controls the coupling between the output unit 200 and the first and second nodes N1 and N2, corresponding to the second control signal CS2 supplied to a second input terminal 220. To this end, the first driver 202 includes a third transistor M3 and a fourth transistor M4.

The third transistor M3 is coupled between the first node N1 and the gate electrode of the first transistor M1. A gate electrode of the third transistor M3 is coupled to the second input terminal 220. The third transistor M3 is turned on when the second control signal CS is supplied to the second input terminal 220, to allow the first node N1 and the gate electrode of the first transistor M1 to be electrically coupled to each other.

The fourth transistor M4 is coupled between the second node N2 and the gate electrode of the second transistor M2. A gate electrode of the fourth transistor M4 is coupled to the second input terminal 220. The fourth transistor M4 is turned on when the second control signal CS2 is supplied to the second input terminal 220, to allow the second node N2 and the gate electrode of the second transistor M2 to be electrically coupled to each other.

The second driver 204 controls the voltage of the first node N1, corresponding to the first control signal CS1 supplied to a first input terminal 210, the second control signal CS2 supplied to the second input terminal 220 and the voltage of the third node N3. To this end, the second driver 204 includes fifth to eighth transistors M5 to M8, a third capacitor C3 and a fourth capacitor C4.

The fifth transistor M5 is coupled between the first power source VDD and the sixth transistor M6. A gate electrode of the fifth transistor M5 is coupled to the second input terminal 220. The fifth transistor M5 is turned on when the second control signal CS2 is supplied to the second input terminal 220, to supply the voltage of the first power source VDD to the sixth transistor M6.

The sixth transistor M6 is coupled between the fifth transistor M5 and the first node N1. A gate electrode of the sixth transistor M6 is coupled to a fourth node N4. The sixth transistor M6 controls the electrical coupling between the fifth transistor M5 and the first node N1, corresponding to a voltage of the fourth node N4.

The seventh transistor M7 is coupled between the first node N1 and a third power source VSS2. A gate electrode of the seventh transistor M7 is coupled to the first input terminal 210. The seventh transistor M7 is turned on when the first control signal CS1 is supplied to the first input terminal 210, to supply the voltage of the third power source VSS2 to the first node N1. Here, the third power source VSS2 is set to a voltage lower than that of the second power source VSS1, i.e., a voltage lower than that obtained by subtracting the absolute threshold voltage of the second transistor M2 from the second power source VSS1. That is, the third power source VSS2 is set to a voltage where the first and second transistors M1 and M2 can be completely turned on.

The eighth transistor M8 is coupled between the third and fourth nodes N3 and N4. A gate electrode of the eighth transistor M8 is coupled to the first input terminal 210. The eighth transistor M8 is turned on when the first control signal CS1 is supplied to the first input terminal 210, to allow the third and fourth nodes N3 and N4 to be electrically coupled to each other.

The third capacitor C3 is coupled between the first power source VDD and the fourth node N4. The third capacitor C3 stores the voltage of the fourth node N4.

The fourth capacitor C4 is coupled between the first node N1 and the third power source VSS2. The fourth capacitor C4 stores the voltage of the first node N1. Here, the fourth capacitor C4 is formed with a capacity (e.g., capacitance) higher than that of the first capacitor C1 so that the first transistor M1 can be stably turned on corresponding to the voltage of the first node N1.

The third driver 206 controls the voltage of the third node N3, corresponding to the data signal supplied to the first output line O1, the first control signal CS1 supplied to the first input terminal 210 and the second control signal CS2 supplied to a third input terminal 222. To this end, the third driver 206 includes ninth to twelfth transistors M9 to M12, a fifth capacitor C5 and a sixth capacitor C6.

The ninth transistor M9 is coupled between the first power source VDD and the third node N3. A gate electrode of the ninth transistor M9 is coupled to a fifth node N5. The ninth transistor M9 controls the electrical coupling between the first power source VDD and the third node N3, corresponding to a voltage of the fifth node N5.

The tenth transistor M10 is coupled between the third node N3 and the third power source VSS2. A gate electrode of the tenth transistor M10 is coupled to the third input terminal 222. The tenth transistor M10 is turned on when the second control signal CS2 is supplied to the third input terminal 222, to supply the voltage of the third power source VSS2 to the third node N3.

The eleventh transistor M11 is coupled between the first power source VDD and the fifth node N5. A gate electrode of the eleventh transistor M11 is coupled to the third input terminal 222. The eleventh transistor M11 is turned on when the second control signal CS is supplied to the third input terminal 222, to supply the voltage of the first power source VDD to the fifth node N5.

The twelfth transistor M12 is coupled between the first output line O1 and the fifth node N5. A gate electrode of the twelfth transistor M12 is coupled to the first input terminal 210. The twelfth transistor M12 is turned on when the first control signal CS1 is supplied to the first input terminal 210, to allow the first output line O1 and the fifth node N5 to be electrically coupled to each other.

The fifth capacitor C5 is coupled between the third node N3 and the third power source VSS2. The fifth capacitor C5 stores the voltage of the third node N3. Here, the fifth capacitor C5 is formed with a capacity (e.g., capacitance) higher than that of the third capacitor C3 so that the voltage of the third node N3 can be stably supplied to the fourth node N4.

The sixth capacitor C6 is coupled between the first power source VDD and the fifth node N5. The sixth capacitor C6 stores the voltage of the fifth node N5.

The fourth driver 208 controls the voltage of the second node N2, corresponding to the data signal supplied to the first output line O1, the first control signal CS1 supplied to the first input terminal 210, and the second control signal CS2 supplied to the second input terminal 220. To this end, the fourth driver 208 includes thirteenth to sixteenth transistors M13 to M16, a seventh capacitor C7 and an eighth capacitor C8.

The thirteenth transistor M13 is coupled between the first power source VDD and the fourteenth transistor M14. A gate electrode of the thirteenth transistor M13 is coupled to the second input terminal 220. The thirteenth transistor M13 is turned on when the second control signal CS2 is supplied to the second input terminal 220, to supply the voltage of the first power source VDD to the fourteenth transistor M14.

The fourteenth transistor M14 is coupled between the thirteenth transistor M13 and the second node N2. A gate electrode of the fourteenth transistor M14 is coupled to a sixth node N6. The fourteenth transistor M14 controls the electrical coupling between the thirteenth transistor M13 and the second node N2, corresponding to a voltage of the sixth node N6.

The fifteenth transistor M15 is coupled between the second node N2 and the third power sources VSS2. A gate electrode of the fifteenth transistor M15 is coupled to the first input terminal 210. The fifteenth transistor M15 is turned on when the first control signal CS1 is supplied to the first input terminal 210, to supply the voltage of the third power source VSS2 to the second node N2.

The sixteenth transistor M16 is coupled between the first output line O1 and the sixth node N6. A gate electrode of the sixteenth transistor M16 is coupled to the first input terminal 210. The sixteenth transistor M16 is turned on when the first control signal CS1 is supplied to the first input terminal 210, to allow the first output line O1 and the sixth node N6 to be electrically coupled to each other.

The seventh capacitor C7 is coupled between the second node N2 and the third power source VSS2. The seventh capacitor C7 stores the voltage of the second node N2. Here, the seventh capacitor C7 is formed with a capacity (e.g., capacitance) higher than that of the second capacitor C2 so that the second transistor M2 can be stably turned on corresponding to the voltage of the second node N2.

The eighth capacitor C8 is coupled between the first power source VDD and the sixth node N6. The eighth capacitor C8 stores the voltage of the sixth node N6.

Meanwhile, a control signal overlapped with a data signal to be supplied, e.g., the first control signal CS1, is supplied to the first input terminal 210. A control signal overlapped with the last data signal, e.g., the second control signal CS2, is supplied to the second input terminal 220. A control signal supplied prior to the first control signal CS1, e.g., the second control signal CS2, is supplied to the third input terminal 222. Here, the first division unit 1622 of FIG. 3 is included in the data divider 162 coupled to the two data lines D1 and D2, and the same control signal CS2 is supplied to the second and third input terminals 220 and 222.

Figure 4:
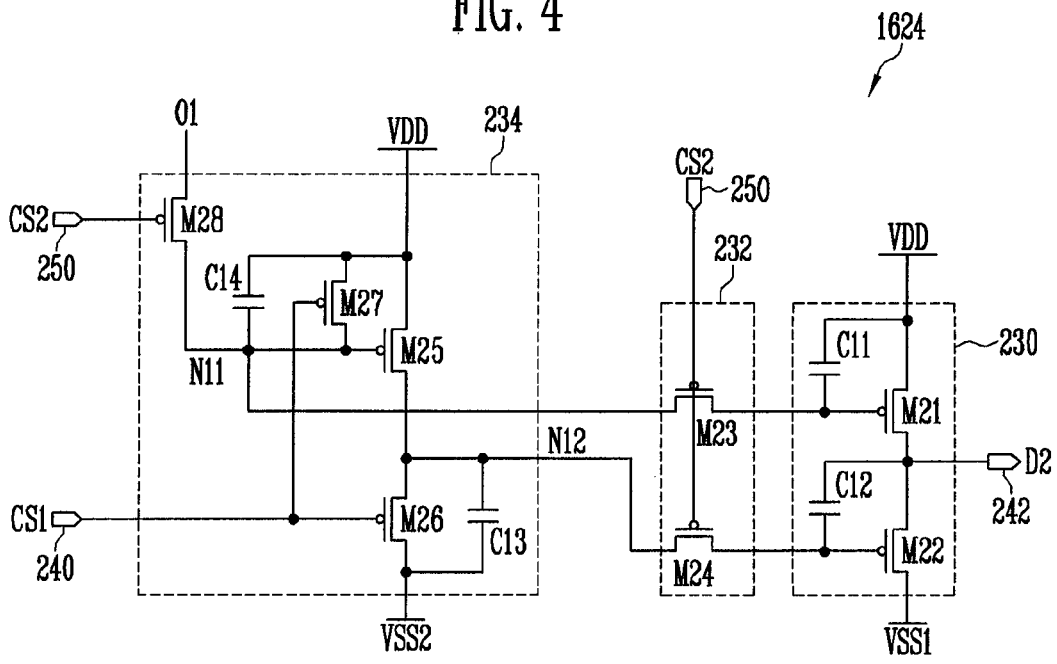
FIG. 4 is a circuit diagram illustrating an embodiment of a second division unit shown in FIG. 2A.

FIG. 4 is a circuit diagram illustrating an embodiment of the second division unit shown in FIG. 2A. For convenience of illustration, the second division unit 1624 coupled to the second data line D2 will be shown in FIG. 4. In FIG. 4, the second division unit 1624 is configured using only PMOS transistors so as to be easily mounted corresponding to the pixels 140 formed with the PMOS transistors.

Referring to FIG. 4, the second division unit 1624 according to this embodiment includes an output unit 230, a first driver 232 and a second driver 234.

The output unit 230 outputs the voltage of the first or second power source VDD or VSS1 as a data signal, corresponding to voltages of first and second nodes N11 and N12. To this end, the output unit 230 includes a first transistor M21, a second transistor M22, a first capacitor C11 and a second capacitor C12.

The first transistor M21 is coupled between the first power source VDD and an output terminal 242. A gate electrode of the first transistor M21 is coupled to the first node N11 via the first driver 232. The first transistor M21 controls the electrical coupling between the first power source VDD and the output terminal 242, corresponding to a voltage supplied to the gate electrode thereof.

The second transistor M22 is coupled between the output terminal 242 and the second power source VSS1. A gate electrode of the second transistor M22 is coupled to the second node N12 via the first driver 232. The second transistor M22 controls the electrical coupling between the second power source VSS1 and the output terminal 242, corresponding to a voltage supplied to the gate electrode of the second transistor M22.

The first capacitor C11 is coupled between the first power source VDD and the gate electrode of the first transistor M21. The first capacitor C11 stores a voltage corresponding to the turn-on or turn-off of the first transistor M21.

The first driver 232 controls the coupling between the output unit 230 and the first and second nodes N11 and N12, corresponding to the second control signal CS2 supplied to a second input terminal 250. To this end, the first driver 232 includes a third transistor M23 and a fourth transistor M24.

The third transistor M23 is coupled between the first node N11 and the gate electrode of the first transistor M21. A gate electrode of the third transistor M23 is coupled to the second input terminal 250. The third transistor M23 is turned on when the second control signal CS2 is supplied to the second input terminal 250, to allow the first node N11 and the gate electrode of the first transistor M21 to be electrically coupled to each other.

The fourth transistor M24 is coupled between the second node N12 and the gate electrode of the second transistor M22. A gate electrode of the fourth transistor M24 is coupled to the second input terminal 250. The fourth transistor M24 is turned on when the second control signal CS2 is supplied to the second input terminal 250, to allow the second node N12 and the gate electrode of the second transistor M22 to be electrically coupled to each other.

The second driver 234 controls the voltages of the first and second nodes N11 and N12, corresponding to the data signal supplied to the first output line O1, the first control signal CS1 supplied to a first input terminal 240, and the second control signal CS2 supplied to the second input terminal 250. To this end, the second driver 234 includes fifth to eighth transistors M25 to M28, a third capacitor C13 and a fourth capacitor C14.

The fifth transistor M25 is coupled between the first power source VDD and the second node N12. A gate electrode of the fifth transistor M25 is coupled to the first node N11. The fifth transistor M25 controls the electrical coupling between the first power source VDD and the second node N12, corresponding to the voltage of the first node N11.

The sixth transistor M26 is coupled between the second node N12 and the third power source VSS2. A gate electrode of the sixth transistor M26 is coupled to the first input terminal 240. The sixth transistor M26 is turned on when the first control signal CS1 is supplied to the first input terminal 240, to supply the voltage of the third power source VSS2 to the second node N12.

The seventh transistor M27 is coupled between the first power source VDD and the first node N11. A gate electrode of the seventh transistor M27 is coupled to the first input terminal 240. The seventh transistor M27 is turned on when the first control signal CS1 is supplied to the first input terminal 240, to supply the voltage of the first power source VDD to the first node N11.

The eighth transistor M28 is coupled between the first output line O1 and the first node N11. A gate electrode of the eighth transistor M28 is coupled to the second input terminal 250. The eighth transistor M28 is turned on when the second control signal CS2 is supplied to the second input terminal 250, to allow the first output line O1 and the first node N11 to be electrically coupled to each other.

The third capacitor C13 is coupled between the second node N12 and the third power source VSS2. The third capacitor C13 stores the voltage of the second node N12. Here, the third capacitor C13 is formed with a capacity (e.g., capacitance) higher than that of the second capacitor C12 so that the second transistor M22 can be stably turned on corresponding to the voltage of the second node N12.

The fourth capacitor C14 is coupled between the first power source VDD and the first node N11. The fourth capacitor C14 stores the voltage of the first node N11.

A control signal overlapped with a data signal, e.g., the second control signal CS2, is supplied to the second input terminal 250. When the second control signal CS2 is supplied to the second input terminal 250, a control signal supplied prior to the second control signal CS2, i.e., the first control signal CS1, is supplied to the first input terminal 240.

Figure 5:
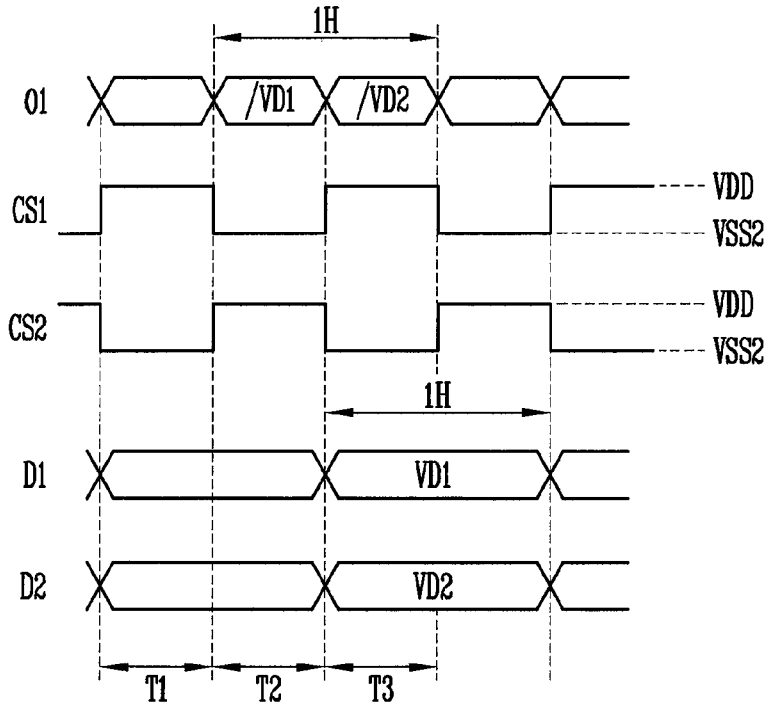
FIG. 5 is a waveform diagram illustrating operating processes of the division units shown in FIGS. 3 and 4.

FIG. 5 is a waveform diagram illustrating operating processes of the division units shown in FIGS. 3 and 4.

The operating process of the first division unit will be described in conjunction with FIGS. 3 and 5. First, the data driver 120 sequentially supplies two reversed data signals /VD1 and /VD2 to the first output line O1 during one horizontal period 1H. The control signal generator 170 sequentially supplies the first and second control signals CS1 and CS2 during the one horizontal period 1H. Here, the first control signal CS1 is supplied in synchronization with a primary data signal /VD1, and the second control signal CS2 is supplied in synchronization with a secondary data signal /VD2. The first and second control signals CS1 and CS2 are set to the voltage of the third power source VSS2 so that the transistors can be stably turned on.

The second control signal CS2 is supplied during a first period T1 so that the tenth, eleventh and thirteenth transistors M10, M11 and M13 are turned on. When the eleventh transistor M11 is turned on, the voltage of the first power source VDD is supplied to the fifth node N5, and accordingly, the ninth transistor M9 is turned off.

When the tenth transistor M10 is turned on, a voltage that is about the same as the voltage of the third power source VSS2 is supplied to the third node N3. Actually, when the tenth transistor M10 is turned on, the voltage higher by the absolute threshold voltage of the tenth transistor M10 than the voltage of the third power source VSS2 is applied to the third node N3. In the following descriptions, it will be assumed that the voltage of the third power source VSS2 is supplied without considering the absolute threshold voltage that has no influence on the operating process. The voltage of the third power source VSS2, supplied to the third node N3, is stored in the fifth capacitor C5.

When the thirteenth transistor M13 is turned on, the voltage of the first power source VDD is supplied to a source electrode of the fourteenth transistor M14. In this case, the fourteenth transistor M14 is turned on or turned off corresponding to a data signal supplied in a previous period. Additionally, when the second control signal CS2 is supplied, the third to fifth transistors M3 to M5 are turned on. When the third to fifth transistors M3 to M5 are turned on, the output unit 200 is controlled corresponding to the data signal supplied in the previous period. This will be described in detail using second to fourth periods T2 to T4.

The first control signal CS1 is supplied during the second period T2 so that the seventh, eighth, twelfth, fifteenth and sixteenth transistors M7, M8, M12, M15 and M16 are turned on.

When the twelfth transistor M12 is turned on, the primary data signal /VD1 is supplied from the first output line O1 to the fifth node N5. When the sixteenth transistor M16 is turned on, the primary data signal /VD1 is supplied from the first output line O1 to the sixth node N6.

Here, when the primary data signal /VD1 is set to a high voltage, the ninth and fourteenth transistors M9 and M14 are turned off. The sixth and eighth capacitors store a voltage corresponding to the high voltage.

When the eighth transistor M8 is turned on, the third and fourth nodes N3 and N4 are electrically coupled to each other. Here, the fifth capacitor C5 is formed with a capacity (e.g., capacitance) higher than that of the third capacitor C3, and hence the fourth node N4 is dropped to about the voltage of the third power source VSS2. In this case, the third capacitor C3 stores a voltage that is about the same as the voltage of the third power source VSS2.

Meanwhile, the fifth and thirteenth transistors M5 and M13 are set in the turn-off state, and the seventh and fifteenth transistors M7 and M15 are turned on. Hence, the first and second node N1 and N2 are dropped to the voltage of the third power source VSS2. In this case, the fourth and seventh capacitors C4 and C7 store the voltage of the third power source VSS2.

Additionally, when the primary data signal /VD1 is set to a low voltage, the ninth and fourteenth transistors M9 and M14 are turned on. When the ninth transistor M9 is turned on, the voltage of the first power source VDD is supplied to the fourth node N4 via the eighth transistor M8. In this case, the third capacitor C3 stores the voltage of the first power source VDD.

Meanwhile, the thirteenth transistor M13 is turned off during the period in which the fourteenth transistor M14 is turned on, and accordingly, the voltage of the first power source VDD is not supplied to the second node N2. However, the eighth capacitor C8 stores a voltage corresponding to the low voltage during the second period T2.

The fifth and thirteenth transistors M5 and M13 are set in the turn-off state, and the seventh and fifteenth transistors M7 and M15 are turned on. Hence, the first and second nodes N1 and N2 are dropped to the voltage of the third power source VSS2. In this case, the fourth and seventh capacitors C4 and C7 store the voltage of the third power source VSS2.

The second control signal CS2 is supplied during the third period T3 so that the third, fifth, tenth, eleventh and thirteenth transistors M3, M5, M10, M11 and M13 are turned on.

When the third transistor M3 is turned on, the first node N1 and the gate electrode of the first transistor M1 are electrically coupled to each other.

When the primary data signal /VD1 is supplied with the high voltage, the third capacitor C3 stores a voltage that is about the same as the voltage of the third power source VSS2. Thus, when the fifth transistor M5 is turned on, the voltage of the first power source VDD is supplied to the first node N1. When the voltage of the first power source VDD is supplied to the first node N1, the first transistor M1 is turned off. The first capacitor C1 stores the voltage of the first power source VDD.

When the thirteenth transistor M13 is turned on, the voltage of the first power source VDD is supplied to the source electrode of the fourteenth transistor M14. In this case, the eighth capacitor C8 stores the high voltage, and hence the fourteenth transistor M14 is set in the turn-off state.

When the fourth transistor M4 is turned on, the second node N2 and the gate electrode of the second transistor M2 are electrically coupled to each other. Here, the seventh capacitor C7 is set to a capacity (e.g., capacitance) higher than that of the second capacitor C2, and hence the gate electrode of the second transistor M2 is dropped to a voltage that is about the same as the voltage of the third power source VSS2. Accordingly, the second transistor M2 is turned on. When the second transistor M2 is turned on, the low voltage, i.e., the voltage of the second power source VSS1, is supplied as a first data signal VD1 to the first data line D1 via the output terminal 212. The second capacitor C2 stores a voltage that is about the same as the voltage of the third power source VSS2. When the tenth and eleventh transistors M10 and M11 are turned on, the voltage of the third node N3 is initialized as the voltage of the third power source VSS2.

When the primary data signal /VD1 is supplied with the low voltage, the third capacitor C3 stores the voltage of the first power source VDD. Thus, although the fifth transistor M5 is turned on, the sixth transistor M6 maintains the turn-off state.

In this case, the third transistor M3 is set in the turn-on state, and hence the voltage of the third power source VSS2, stored in the fourth capacitor C4, is supplied to the gate electrode of the first transistor M1. Accordingly, the first transistor M1 is turned on (C3>C1). When the first transistor M1 is turned on, the voltage of the first power source VDD is supplied as a second data signal VD2 to the first data line D1 via the output terminal 212. The first capacitor C1 stores a voltage that is about the same as the voltage of the third power source VSS2.

When the thirteenth transistor M13 is turned on, the voltage of the first power source VDD is supplied to the source electrode of the fourteenth transistor M14. In this case, the low voltage is stored in the eighth capacitor C8, and accordingly, the fourteenth transistor M14 is turned on. When the fourteenth transistor M14 is turned on, the voltage of the first power source VDD is supplied to the gate electrode of the second transistor M2 via the second node N2 and the fourth transistor M4, and accordingly, the second transistor M2 is turned off. In this case, the second capacitor C2 stores the voltage of the first power source VDD.

Subsequently, the first and second transistors M1 and M2 supply the first data signal VD1 to the first data line D1 while maintaining the turn-on state and/or the turn-off state until before the next second control signal CS2 is supplied.

As described above, the first division unit 1622 of the described embodiment according to the present invention receives the reversed primary data signal /VD1 during a ½H period, and reverses the received primary data signal /VD1, to supply the reversed data signal as the first data signal VD1 to the first data line D1 during the one horizontal period 1H.

The operating process of the second division unit will be described in conjunction with FIGS. 4 and 5. First, the first control signal CS1 is supplied during the second period T2 so that sixth and seventh transistors M26 and M27 are turned on. When the sixth transistor M26 is turned on, the voltage of the third power source VSS2 is supplied to the second node N12. In this case, the third capacitor C13 stores the voltage of the third power source VSS2. When the seventh transistor M27 is turned on, the voltage of the first power source VDD is supplied to the first node N11. In this case, the fourth capacitor C14 stores the voltage of the first power source VDD.

The second control signal CS2 is supplied during the third period T3 so that the third, fourth and eighth transistors M23, M24 and M28 are turned on. When the eighth transistor M28 is turned on, the secondary data signal /VD2 output from the first output line O1 is supplied to the first node N11.

Here, the secondary data signal /VD2 is set to the high voltage, and the voltage of the first node N11 is raised to the high voltage. When the voltage of the first node N11 is set to the high voltage, the fifth transistor M25 is turned off. The first transistor M21 of which gate electrode is coupled to the first node N11 is also set in the turn-off state, corresponding to the turn-on of the third transistor M23.

When the fourth transistor M24 is turned on, the second node N12 and the gate electrode of the second transistor M22 are electrically coupled to each other. Then, the second transistor M22 is set in the turn-on state by the voltage of the third power source VSS2, which is stored in the third capacitor C13. When the second transistor M22 is set in the turn-on state, the voltage of the second power source VSS1 is supplied as the first data signal VD1 to the second data line D2 via the output terminal 242. During the third period T3, the third capacitor C13 is set to a capacity (e.g., capacitance) higher than that of the second capacitor C12, and hence a voltage that is about the same as the voltage of the third power source VSS2 is stored in the second capacitor C12.

When the secondary data signal /VD2 is set to the low voltage, the first node N11 is set to the low voltage. When the first node N11 is set to the low voltage, the fifth transistor M25 is turned on. The first transistor M21 of which gate electrode is coupled to the first node N11 is also set in the turn-on state, corresponding to the turn-on of the third transistor M23. When the first transistor M21 is turned on, the voltage of the first power source VDD is supplied as the second data signal VD2 to the second data line D2 via the output terminal 242. In this case, the first capacitor C11 stores the voltage of the first power source VDD.

When the fifth transistor M25 is turned on, the voltage of the first power source VDD is supplied to the second node N12. In this case, the fourth transistor M24 is set in the turn-on state, and hence the voltage of the first power source VDD is supplied to the gate electrode of the second transistor M22. Accordingly, the second transistor M22 is set in the turn-off state. The second capacitor C12 stores the voltage of the first power source VDD.

As described above, the second division unit 1624 of the described embodiment of the present invention receives the reversed secondary data signal /VD2 during a ½H period, and reverses the received secondary data signal /VD2, to supply the reversed data signal as the second data signal VD2 to the second data line D2 during the one horizontal period 1H.

Meanwhile, FIGS. 3 and 4 show a case where the data divider 162 is coupled to two data lines D1 and D2. Here, the operating process of the data divider 162 coupled to three or more data lines D is substantially identical to that of the data divider 162 coupled to the two data lines D1 and D2, except that only control signals supplied to input terminals are changed.

Figure 6A:
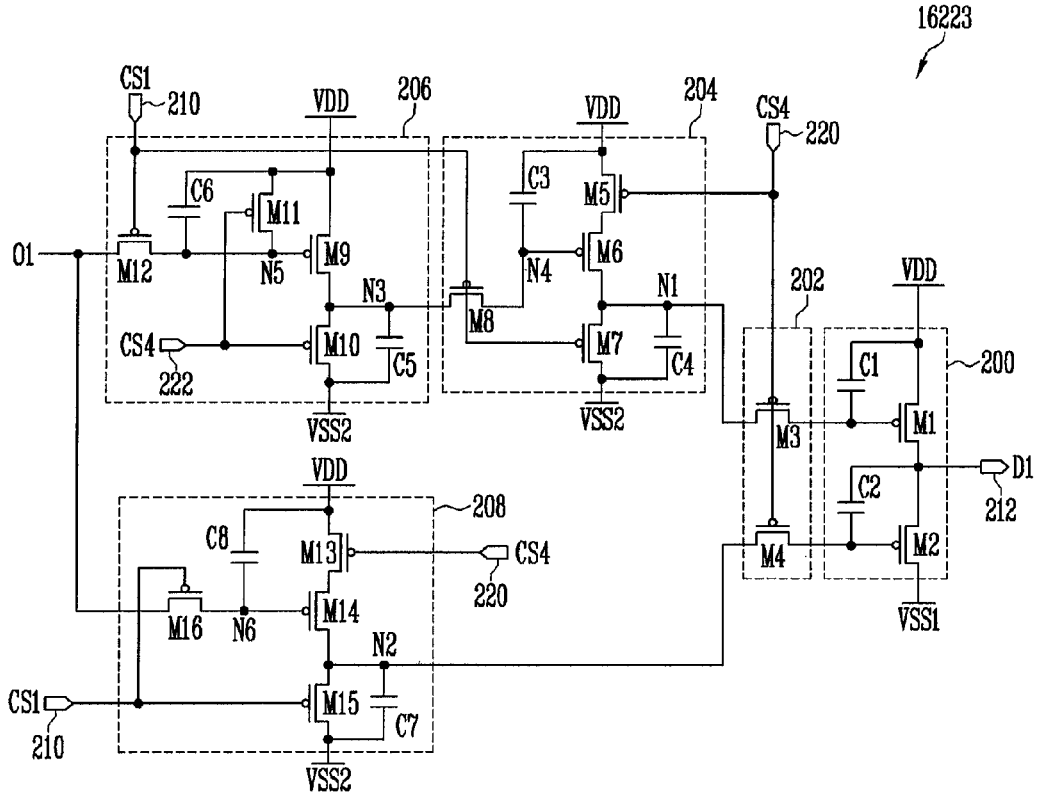
FIGS. 6A to 6C are circuit diagrams illustrating the other division units except for a division unit that finally receives a data signal when the data divider is coupled to four data lines.
Figure 6B:
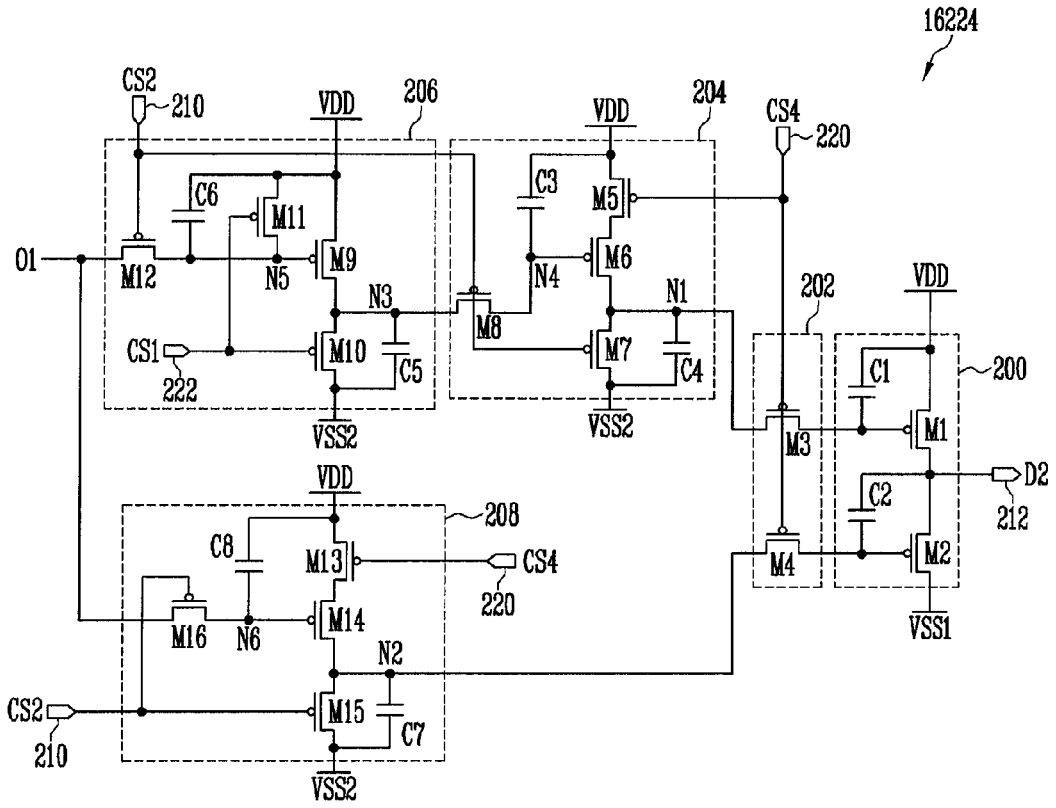
Figure 6C:
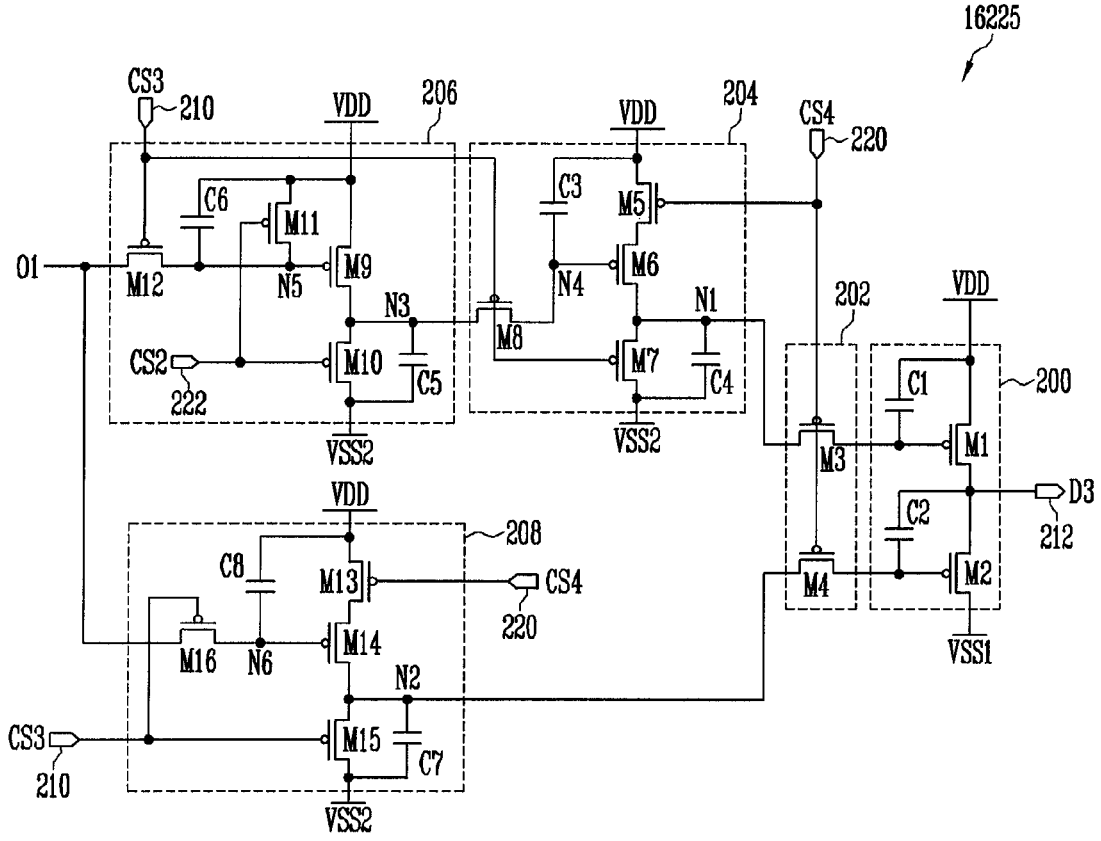

FIGS. 6A to 6C are circuit diagrams illustrating the other division units except for a division unit that finally receives a data signal when the data divider is coupled to four data lines. In FIGS. 6A to 6C, components identical to those of FIG. 3 are designated by like reference numerals, and their detailed descriptions may be omitted.

Figure 8:
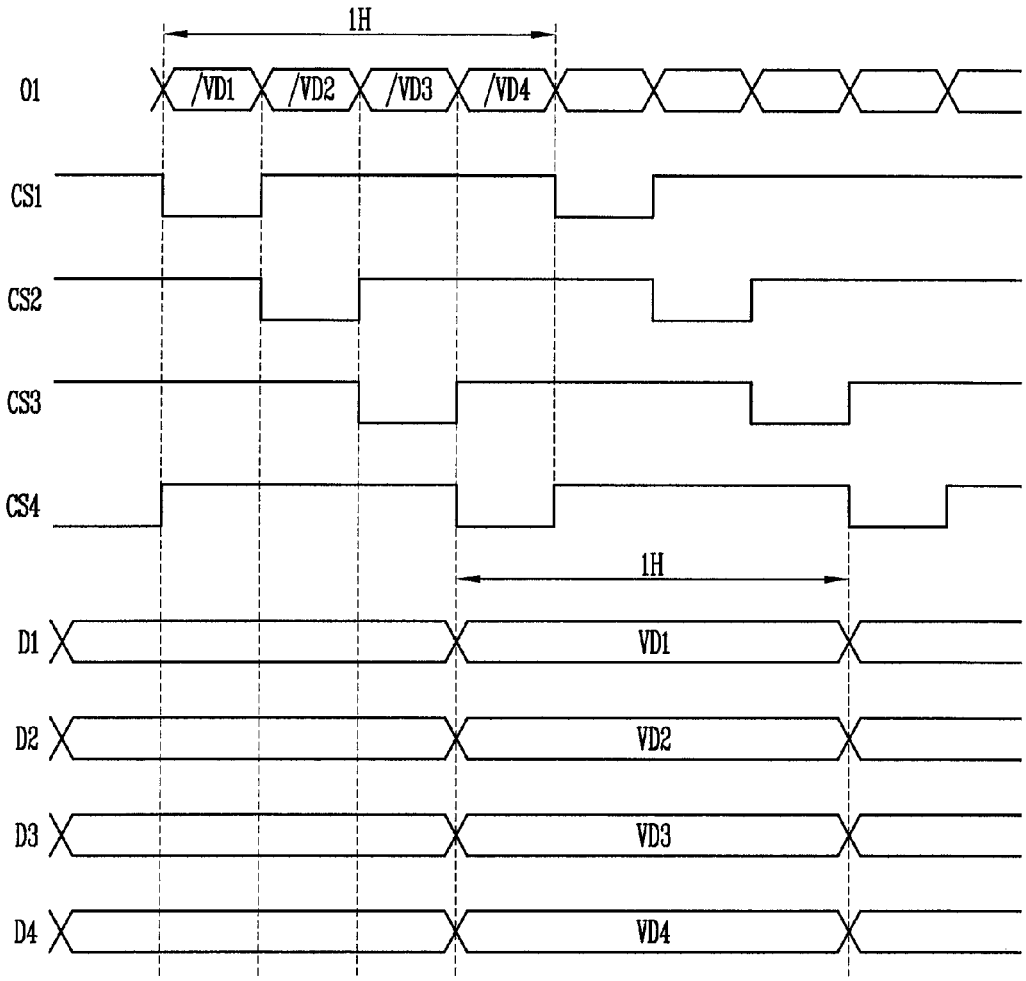
FIG. 8 is a waveform diagram illustrating operating processes of the division units.

FIG. 8 is a waveform diagram illustrating operating processes of the division units.

The operating processes of the division units will be described in conjunction with FIGS. 6A to 6C and FIG. 8. First, a control signal overlapped with a data signal /VD1, i.e., the first control signal CS1, is supplied to a first input terminal 210 of the first division unit 16223. Also, a control signal overlapped with a data signal /VD4 finally supplied to the first division unit 16223, i.e., the fourth control signal CS4, is supplied to a second input terminal 220 of the first division unit 16223. In addition, a control signal supplied prior to the first control signal CS1 supplied to the first input terminal 210, i.e., the fourth control signal CS4, is supplied to a third input terminal 222 of the first division unit 16223. The first division unit 16223 initializes voltages of the fifth and third nodes N5 and N3, corresponding to the fourth control signal CS4 supplied to the third input terminal 222, and stores the data signal /VD1, corresponding to the first control signal CS1 supplied to the first input terminal 210. Subsequently, the first division unit 16223 reverses the stored data signal /VD1, corresponding to the fourth control signal CS4 supplied to the third input terminal 222, and supplies the reversed data signal VD1 to the first data line D1 during one horizontal period 1H.

A control signal overlapped with a data signal /VD2, i.e., the second control signal CS2, is supplied to the first input terminal 210 of the second division unit 16224. Also, a control signal overlapped with the data signal /VD4 finally supplied to the second division unit 16224, i.e., the fourth control signal CS4, is supplied to a second input terminal 220 of the second division unit 16224. In addition, a control signal supplied prior to the second control signal CS2 supplied to the first input terminal 210, i.e., the first control signal CS1, is supplied to a third input terminal 222 of the second division unit 16224. The second division unit 16224 initializes fifth and third nodes N5 and N3, corresponding to the first control signal CS1 supplied to the third input terminal 222, and stores the data signal /VD2, corresponding to the second control signal CS2 supplied to the first input terminal 210. Subsequently, the second division unit 16224 reverses the stored data signal /VD2, corresponding to the fourth control signal CS4 supplied to the second input terminal 220, and supplies the reversed data signal VD2 to the second data line D2 during one horizontal period 1H.

A control signal overlapped with a data signal /VD3, i.e., the third control signal CS3, is supplied to the first input terminal 210 of the third division unit 16225. Also, a control signal overlapped with the data signal /VD4 finally supplied to the third division unit 16225, i.e., the fourth control signal CS4, is supplied to a second input terminal 220 of the third division unit 16225. In addition, a control signal supplied prior to the third control signal CS3 supplied to the first input terminal 210, i.e., the second control signal CS2, is supplied to a third input terminal 222 of the third division unit 16225.

The third division unit 16225 initializes fifth and third nodes N5 and N3, corresponding to the second control signal CS2 supplied to the third input terminal 222, and stores the data signal /VD3, corresponding to the third control signal CS3 supplied to the first input terminal 210. Subsequently, the third division unit 16225 reverses the stored data signal /VD3, corresponding to the fourth control signal CS4 supplied to the second input terminal 220, and supplies the reversed data signal VD3 to the third data line D3 during one horizontal period 1H.

The operating processes of the first to third division units 16223 to 16225 are substantially identical to those of FIG. 3, and therefore, their detailed descriptions will be omitted.

Figure 7:
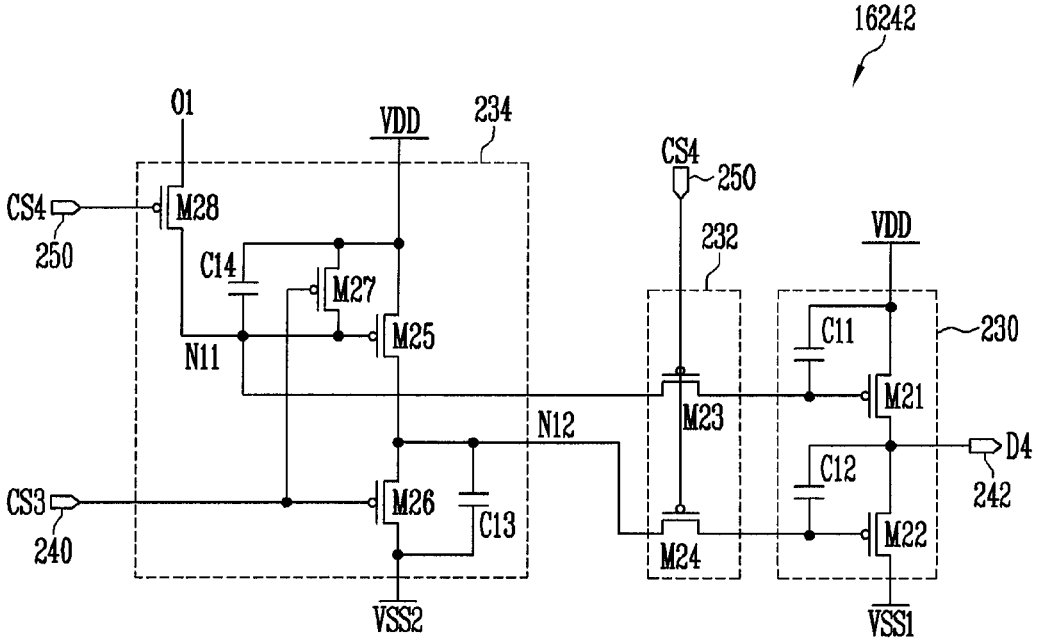
FIG. 7 is a circuit diagram illustrating the division unit that finally receives the data signal when the data divider is coupled to the four data lines.

FIG. 7 is a circuit diagram illustrating the division unit finally receiving the data signal when the data divider is coupled to the four data lines. In FIG. 7, components identical to those of FIG. 4 are designated by like reference numerals, and their detailed descriptions may be omitted.

The operating process of the division unit will be described in conjunction with FIGS. 7 and 8. First, a control signal overlapped with the data signal /VD4 to be supplied, i.e., the fourth control signal CS4, is supplied to the second input terminal 250 of the fourth division unit 16242. In addition, a control signal supplied prior to the fourth control signal CS4, i.e., the third control signal CS3, is supplied to a first input terminal 240 of the fourth division unit 16242. The fourth division unit 16242 initializes voltages of first and second nodes N11 and N12, corresponding to the third control signal CS3 supplied to the first input terminal 240. The fourth division unit 16242 reverses the data signal /VD4 supplied thereto, corresponding to the fourth control signal CS4 supplied to the second input terminal 250, and supplies the reversed data signal VD4 to the fourth data line D4 during one horizontal period 1H.

The operating process of the fourth division unit 16242 is substantially identical to that of FIG. 4, and therefore, their detailed descriptions may be omitted.

Figure 9:
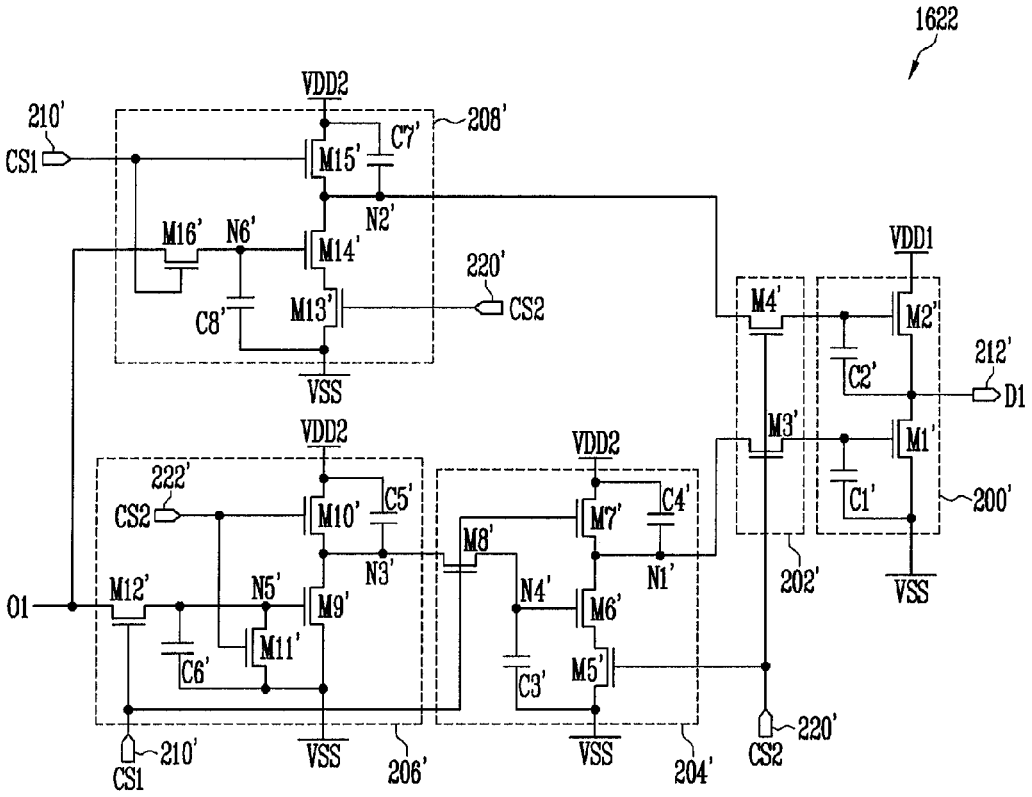
FIG. 9 is a circuit diagram illustrating another embodiment of the first division unit shown in FIG. 2A.

FIG. 9 is a circuit diagram illustrating another embodiment of the first division unit shown in FIG. 2A. In FIG. 9, the first division unit 1622 is configured using only NMOS transistors so as to be easily mounted corresponding to the pixels 140 formed with the NMOS transistors. That is, the operating process of the first division unit of FIG. 9 is substantially identical to that of the first division unit shown in FIG. 3, except that only the conductive type of the transistors in the division unit shown in FIG. 3 has been changed. However, when the conductive type of the transistors is changed from PMOS to NMOS, the polarity of control signals are changed (e.g., from the low voltage to the high voltage), and the polarity of a power source coupled to the transistors is also changed.

Referring to FIG. 9, the first division unit 1622 according to this embodiment includes an output unit 200', a first driver 202', a second driver 204', a third driver 206' and a fourth driver 208'.

The output unit 200' outputs the voltage of first or second power source VSS or VDD1 as a data signal, corresponding to voltages of first and second nodes N1' and N2'. The first driver 202' controls the coupling between the output unit 200' and the first and second nodes N1' and N2'. The fourth driver 208' controls the voltage of the second node N2', corresponding to a voltage of a first output line O1. The second driver 204' controls the voltage of the first node N1', corresponding to a voltage of a third node N3'. Here, the second and fourth drivers 204' and 208' are implemented with substantially the same circuit. The third driver 206' controls the voltage of the third node N3', corresponding to the voltage of the first output line O1.

The output unit 200' supplies the voltage of the first or second power source VSS or VDD1 to an output terminal 212', corresponding to the voltages of the first and second nodes N1' and N2'. Here, the first power source VSS is set to a voltage lower than that of the second power source VDD1. For example, the voltage of the first power source VSS may be supplied as a second data signal to the pixel 140, and the voltage of the second power source VDD1 may be supplied as a first data signal to the pixel 140. The voltage of the first or second power source VSS or VDD1 supplied to the output terminal 212' is supplied as a data signal to the first data line D1.

The output unit 200' includes a first transistor M1', a second transistor M2', a first capacitor C1' and a second capacitor C2'. The first transistor M1' is coupled between the first power source VSS and the output terminal 212'. A gate electrode of the first transistor M1' is coupled to the first node N1' via the first driver 202'. The first transistor M1' controls the electrical coupling between the first power source VSS and the output terminal 212', corresponding to a voltage supplied to the gate electrode thereof.

The second transistor M2' is coupled between the output terminal 212' and the second power source VDD1. A gate electrode of the second transistor M2' is coupled to the second node N2' via the first driver 202'. The second transistor M2' controls the electrical coupling between the second power source VDD1 and the output terminal 212', corresponding to a voltage supplied to the gate electrode of the second transistor M2'.

The first capacitor C1' is coupled between the gate electrode of the first transistor M1' and the first power source VSS. The first capacitor C1' stores a voltage corresponding to the turn-on or turn-off of the first transistor M1'.

The second capacitor C2' is coupled between the gate electrode of the second transistor M2' and the output terminal 212'. The second capacitor C2' stores a voltage corresponding to the turn-on or turn-off of the second transistor M2'.

The first driver 202' controls the coupling between the output unit 200' and the first and second nodes N1' and N2', corresponding to a second control signal CS2 supplied to a second input terminal 220'. To this end, the first driver 202' includes a third transistor M3' and a fourth transistor M4'.

The third transistor M3' is coupled between the first node N1' and the gate electrode of the first transistor M1'. A gate electrode of the third transistor M3' is coupled to the second input terminal 220'. The third transistor M3' is turned on when the second control signal CS2 is supplied to the second input terminal 220', to allow the first node N1' and the gate electrode of the first transistor M1' to be electrically coupled to each other.

The fourth transistor M4' is coupled between the second node N2' and the gate electrode of the second transistor M2'. A gate electrode of the fourth transistor M4' is coupled to the second input terminal 220'. The fourth transistor M4' is turned on when the second control signal CS is supplied to the second input terminal 220', to allow the second node N2' and the gate electrode of the second transistor M2' to be electrically coupled to each other.

The second driver 204' controls the voltage of the first node N1', corresponding to a first control signal CS1 supplied to a first input terminal 210', the second control signal CS2 supplied to the second input terminal 220' and the voltage of the third node N3'. To this end, the second driver 204' includes fifth to eighth transistors M5' to M8', a third capacitor C3' and a fourth capacitor C4'.

The fifth transistor M5' is coupled between the first power VSS and the sixth transistor M6'. A gate electrode of the fifth transistor M5' is coupled to the second input terminal 220'. The fifth transistor M5' is turned on when the second control signal CS2 is supplied to the second input terminal 220', to supply the voltage of the first power source VSS to the sixth transistor M6'.

The sixth transistor M6' is coupled between the fifth transistor M5' and the first node N1'. A gate electrode of the sixth transistor M6' is coupled to a fourth node N4'. The sixth transistor M6' controls the electrical coupling between the fifth transistor M5' and the first node N1', corresponding to a voltage of the fourth node N4'.

The seventh transistor MT is coupled between the first node N1' and a third power source VDD2. A gate electrode of the seventh transistor MT is coupled to the first input terminal 210'. The seventh transistor M7' is turned on when the first control signal CS1 is supplied to the first input terminal 210', to supply the voltage of the third power source VDD2 to the first node N1'. Here, the third power source VDD2 is set to a voltage higher than that of the second power source VDD1, e.g., a voltage higher than that obtained by adding the absolute threshold voltage of the second transistor M2' to the voltage of the third power source VDD2. That is, the third power source VDD2 is set to a voltage where the first and second transistors M1' and M2' can be completely turned on.

The eighth transistor M8' is coupled between the third and fourth nodes N3' and N4'. A gate electrode of the eighth transistor M8' is coupled to the first input terminal 210'. The eighth transistor M8' is turned on when the first control signal CS1 is supplied to the first input terminal 210', to allow the third and fourth nodes N3' and N4' to be electrically coupled to each other.

The third capacitor C3' is coupled between the first power source VSS and the fourth node N4'. The third capacitor C3' stores the voltage of the fourth node N4'.

The fourth capacitor C4' is coupled between the first node N1' and the third power source VDD2. The fourth capacitor C4' stores the voltage of the first node N1'. Here, the fourth capacitor C4' is formed with a capacity (e.g., capacitance) higher than that of the first capacitor C1' so that the first transistor M1' can be stably turned on corresponding to the voltage of the first node N1'.

The third driver 206' controls the voltage of the third node N3', corresponding to a data signal supplied to the first output line O1, the first signal CS1 supplied to the first input terminal 210', and the second control signal CS2 supplied to a third input terminal 222'. To this end, the third driver 206' includes ninth to twelfth transistors M9' to M12', a fifth capacitor C5' and a sixth capacitor C6'.

The ninth transistor M9' is coupled between the first power source VSS and the third node N3'. A gate electrode of the ninth transistor M9' is coupled to a fifth node N5'. The ninth transistor M9' controls the electrical coupling between the first power source VSS and the third node N3', corresponding to a voltage of the fifth node N5'.

The tenth transistor M10' is coupled between the third node N3' and the third power source VDD2. A gate electrode of the tenth transistor M10' is coupled to the third input terminal 222'. The tenth transistor M10' is turned on when the second control signal CS2 is supplied to the third input terminal 222', to supply the voltage of the third power source VDD2 to the third node N3'.

The eleventh transistor M11' is coupled between the first power source VSS and the fifth node N5'. A gate electrode of the eleventh transistor M11' is coupled to the third input terminal 222'. The eleventh transistor M11' is turned on when the second control signal CS2 is supplied to the third input terminal 222', to supply the voltage of the first power source VSS to the fifth node N5'.

The twelfth transistor M12' is coupled between the first output line O1 and the fifth node N5'. A gate electrode of the twelfth transistor M12' is coupled to the first input terminal 210'. The twelfth transistor M12' is turned on when the first control signal CS1 is supplied to the first input terminal 210', to allow the first output line O1 and the fifth node N5' to be electrically coupled to each other.

The fifth capacitor C5' is coupled between the third node N3' and the third power source VDD2. The fifth capacitor C5' stores the voltage of the third node N3'. Here, the fifth capacitor C5' is formed with a capacity (e.g., capacitance) higher than that of the third capacitor C3' so that the voltage of the third node N3' can be stably supplied to the fourth node N4'.

The sixth capacitor C6' is coupled between the first power source VSS and the fifth node N5'. The sixth capacitor C6' stores the voltage of the fifth node N5'.

The fourth driver 208' controls the voltage of the second node N2', corresponding to the data signal supplied to the first output line O1, the first control signal CS1 supplied to the first input terminal 210', and the second control signal CS2 supplied to the second input terminal 220'. To this end, the fourth driver 208' includes thirteenth to sixteenth transistors M13' to M16', a seventh capacitor C7' and an eighth capacitor C8'.

The thirteenth transistor M13' is coupled between the first power source VSS and the fourteenth transistor M14'. A gate electrode of the thirteenth transistor M13' is coupled to the second input terminal 220'. The thirteenth transistor M13' is turned on when the second control signal CS2 is supplied to the second input terminal 220', to supply the voltage of the first power source VSS to the fourteenth transistor M14'.

The fourteenth transistor M14' is coupled between the thirteenth transistor M13' and the second node N2'. A gate electrode of the fourteenth transistor M14' is coupled to a sixth node N6'. The fourteenth transistor M14' controls the electrical coupling between the thirteenth transistor M13' and the second node N2', corresponding to a voltage of the sixth node N6'.

The fifteenth transistor M15' is coupled between the second node N2' and the third power source VDD2. A gate electrode of the fifteenth transistor M15' is coupled to the first input terminal 210'. The fifteenth transistor M15' is turned on when the first control signal CS1 is supplied to the first input terminal 210', to supply the voltage of the third power source VDD2 to the second node N2'.

The sixteenth transistor M16' is coupled to the first output line O1 and the sixth node N6'. A gate electrode of the sixteenth transistor M16' is coupled to the first input terminal 210'. The sixteenth transistor M16' is turned on when the first control signal CS1 is supplied to the first input terminal 210', to allow the first output line O1 and the sixth node N6' to be electrically coupled to each other.

The seventh capacitor C7' is coupled between the second node N2' and the third power source VDD2. The seventh capacitor C7' stores the voltage of the second node N2'. Here, the seventh capacitor C7' is formed with a capacity (e.g., capacitance) higher than that of the second capacitor C2' so that the second transistor M2' can be stably turned on corresponding to the voltage of the second node N2'.

The eighth capacitor C8' is coupled between the first power source VSS and the sixth node N6'. The eighth capacitor C8' stores the voltage of the sixth node N6'.

Meanwhile, a control signal overlapped with a data, e.g., the first control signal CS1, is supplied to the first input terminal 210'. Also, a control signal overlapped with a data signal finally supplied to the second input terminal 220', e.g., the second control signal CS2, is supplied to the second input terminal 220'. In addition, a control signal supplied prior to the first control signal CS1, i.e., the second control signal CS2, is supplied to the third input terminal 222'.

Figure 11:
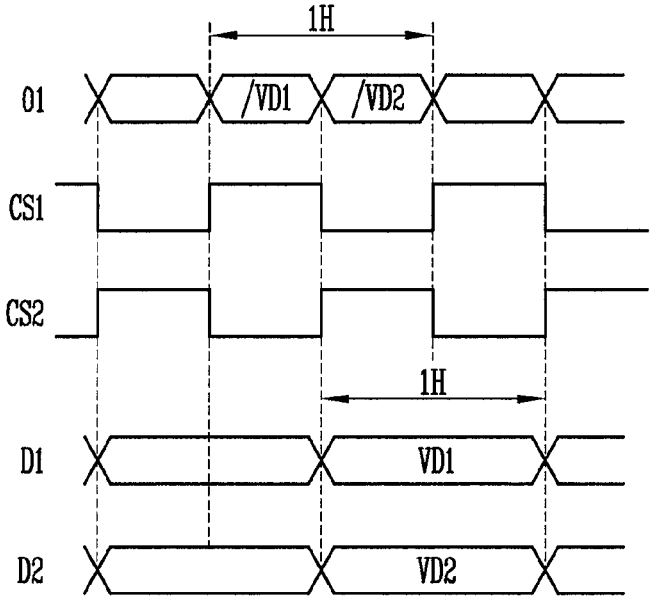
FIG. 11 is a waveform diagram illustrating operating processes of the division units shown in FIGS. 9 and 10.

The first division unit 1622 according to this embodiment is implemented by replacing the PMOS transistors constituting the first division unit of FIG. 3 with NMOS transistors, and the voltage of the power source is changed as described above. When the PMOS transistors are replaced by the NMOS transistors, the polarities of the first and second control signals are reversed as shown in FIG. 11. Except for the change to the conductive type of the transistors and polarities of the control signals, the operating process of the first division unit 1622 according to this embodiment is substantially identical to that of the first division unit of FIG. 3, and therefore, its detailed description related to the driving method may be omitted.

Figure 10:
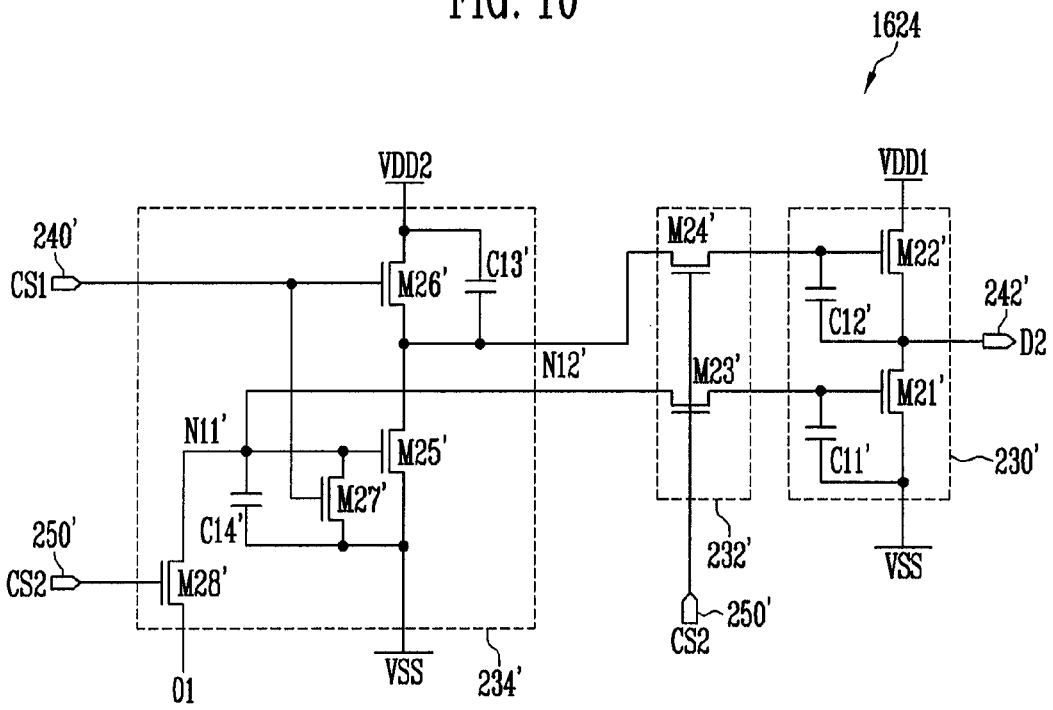
FIG. 10 is a circuit diagram illustrating another embodiment of the second division unit shown in FIG. 2A.

FIG. 10 is a circuit diagram illustrating another embodiment of the second division unit shown in FIG. 2A. In FIG. 10, the second division unit 1624 is configured using only NMOS transistors so as to be easily mounted corresponding to the pixels 140 formed with the NMOS transistors. That is, the operating process of the second division unit of FIG. 10 is substantially identical to that of the second division unit shown in FIG. 4, except that only the conductive type of the transistors in the division unit shown in FIG. 4 is changed. However, when the conductive type of the transistors is changed from PMOS into NMOS, the polarity of a control signal is changed (from the low voltage to the high voltage), and the polarity of a power source coupled to the transistors is changed.

Referring to FIG. 10, the second division unit 1624 according to this embodiment includes an output unit 230', a first driver 232' and a second driver 234'.

The output unit 230' outputs the voltage of first or second power source VSS or VDD1 as a data signal corresponding to voltages of first and second nodes N11' and N12'. To this end, the output unit 230' includes a first transistor M21', a second transistor M22', a first capacitor C11' and a second capacitor C12'.

The first transistor M21' is coupled between the first power source VSS and an output terminal 242'. A gate electrode of the first transistor M21' is coupled to the first node N11' via the first driver 232'. The first transistor M21' controls the electrical coupling between the first power source VSS and the output terminal 242', corresponding to a voltage supplied to the gate electrode of the first transistor M21'.

The second transistor M22' is coupled between the output terminal 242' and the second power source VDD1. A gate electrode of the second transistor M22' is coupled to the second node N12' via the first driver 232'. The second transistor M22' controls the electrical coupling between the second power source VDD and the output terminal 242', corresponding to a voltage supplied to the gate electrode thereof.

The first capacitor C11' is coupled between the first power source VSS and the gate electrode of the first transistor M21'. The first capacitor C11' stores a voltage corresponding to the turn-on or turn-off of the first transistor M21'.

The second capacitor C12' is coupled between the output terminal 242' and the gate electrode of the second transistor M22'. The second capacitor C12' stores a voltage corresponding to the turn-on or turn-off of the second transistor M22'.

The first driver 232' controls the coupling between the output unit 230' and the first and second nodes N11' and N12', corresponding to a second control signal CS2 supplied to a second input terminal 250'. To this end, the first driver 232' includes a third transistor M23' and a fourth transistor M24'.

The third transistor M23' is coupled between the first node N11' and the gate electrode of the first transistor M21'. A gate electrode of the third transistor M23' is coupled to the second input terminal 250'. The third transistor M23' is turned on when the second control signal CS2 is supplied to the second input terminal 250', to allow the first node N11' and the gate electrode of the first transistor M21' to be electrically coupled to each other.

The fourth transistor M24' is coupled between the second node N12' and the gate electrode of the second transistor M22'. A gate electrode of the fourth transistor M24' is coupled to the second input terminal 250'. The fourth transistor M24' is turned on when the second control signal CS2 is supplied to the second input terminal 250', to allow the second node N12' and the gate electrode of the second transistor M22' to be electrically coupled to each other.

The second driver 234' controls the voltages of the first and second nodes N11' and N12', corresponding to a data signal supplied to the first output line O1, a first control signal supplied to a first input terminal 240', and the second control signal supplied to the second input terminal 250'. To this end, the second driver 234' includes fifth to eighth transistors M25' to M28', a third capacitor C13' and a fourth capacitor C14'.

The fifth transistor M25' is coupled between the first power source VSS and the second node N12'. A gate electrode of the fifth transistor M25' is coupled to the first node N11'. The fifth transistor M25' controls the electrical coupling between the first power source VSS and the second node N12', corresponding to the voltage of the first node N11'.

The sixth transistor M26' is coupled between the second node N12' and a third power source VDD2. A gate electrode of the sixth transistor M26' is coupled to the first input terminal 240'. The sixth transistor M26' is turned on when the first control signal CS1 is supplied to the first input terminal 240', to supply the voltage of the third power source VDD2 to the second node N12'.

The seventh transistor M27' is coupled between the first power source VSS and the first node N11'. A gate electrode of the seventh transistor M27' is coupled to the first input terminal 240'. The seventh transistor M27' is turned on when the first control signal CS1 is supplied to the first input terminal 240', to supply the voltage of the first power source VSS to the first node N11'.

The eighth transistor M28' is coupled to the first output line O1 and the first node N11'. A gate electrode of the eighth transistor M28' is coupled to the second input terminal 250'. The eighth transistor M28' is turned on when the second control signal CS2 is supplied to the second input terminal 250', to allow the first output line O1 and the first node N11' to be electrically coupled to each other.

The third capacitor C13' is coupled between the second node N12' and the third power source VDD2. The third capacitor C13' stores the voltage of the second node N12'. Here, the third capacitor C13' is formed with a capacity (e.g., capacitance) higher than that of the second capacitor C12' so that the second transistor M22' can be stably turned on corresponding to the voltage of the second node N12'.

The fourth capacitor C14' is coupled between the first power source VSS and the first node N11'. The fourth capacitor C14' stores the voltage of the first node N11'.

Meanwhile, a control signal overlapped with a data signal, e.g., the second control signal CS2, is supplied to the second input terminal 250'. When the second control signal CS2 is supplied to the second input terminal 250', a control signal supplied prior to the second control signal CS2, i.e., the first control signal CS1, is supplied to the first input terminal 240'.

The second division unit 1624 according to this embodiment is implemented by replacing the PMOS transistors constituting the first division unit of FIG. 4 with NMOS transistors, and the voltage of the power source is changed as described above. When the PMOS transistors are replaced by the NMOS transistors, the polarities of the first and second control signals are reversed as shown in FIG. 11. Except for the changes to the polarities of the control signals, the operating process of the second division unit 1624 according to this embodiment is substantially identical to that of the first division unit of FIG. 4, and therefore, its detailed description related to the driving method may be omitted.

Figure 12:
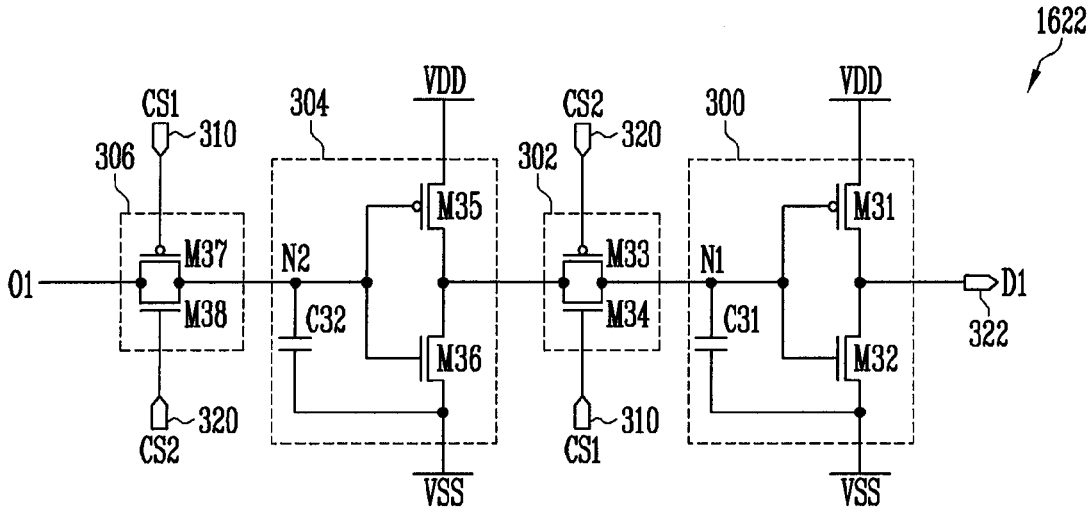
FIG. 12 is a circuit diagram illustrating still another embodiment of the first division unit shown in FIG. 2A.

FIG. 12 is a circuit diagram illustrating still another embodiment of the first division unit shown in FIG. 2A. In FIG. 12, the first division unit 1622 is configured using PMOS and NMOS transistors.

Referring to FIG. 12, the first division unit 1622 according to this embodiment includes an output unit 300, a first driver 302, a second driver 304, and a third driver 306. The output unit 300 and the second driver 304 may be driven as inverters, and the first and third drivers 302 and 306 may perform a function of transmitting data (e.g., data signals).

The output unit 300 supplies the voltage of first or second power source VDD or VSS to an output terminal 322, corresponding to a voltage of the first node N1. Here, the first power source VDD is set to a voltage higher than that of the second power source VSS. The output unit 300 supplies the voltage of the first or second power source VDD or VSS as a data signal to a first data line D1. To this end, the output unit 300 includes a first transistor M31 and a second transistor M32.

The first transistor M31 is coupled between the first power source VDD and the output terminal 322. A gate electrode of the first transistor M31 is coupled to the first node N1. The first transistor M31 controls the coupling between the first power source VDD and the output terminal 322, corresponding to the voltage of the first node N1. To this end, the first transistor M31 is formed as a PMOS transistor.

The second transistor M32 is coupled between the output terminal 322 and the second power source VSS. A gate electrode of the second transistor M32 is coupled to the first node N1. The second transistor M32 controls the coupling between the second power source VSS and the output terminal 322, corresponding to the voltage of the first node N1. To this end, the second transistor M32 is formed as an NMOS transistor.

The first capacitor 31 is coupled between the first node N1 and the second power source VSS. The first capacitor 31 stores the voltage of the first node N1.

The first driver 302 controls the coupling between the first node N1 and the second driver 304, corresponding to a first control signal CS1 supplied to a first input terminal 310 and a second control signal CS2 supplied to a second input terminal 320. To this end, the first driver 320 includes a third transistor M33 and a fourth transistor M34.

The third transistor M33 is coupled between the second driver 304 and the first node N1. A gate electrode of the third transistor M33 is coupled to the second input terminal 320. The third transistor M33 is turned on when the second control signal CS2 having a low voltage is supplied to the second input terminal 320, to allow the second driver 304 and the first node N1 to be electrically coupled to each other. To this end, the third transistor M33 is formed as a PMOS transistor.

The fourth transistor M34 is coupled between the second driver 304 and the first node N1. A gate electrode of the fourth transistor M34 is coupled to the first input terminal 310. The fourth transistor M34 is turned on when the first control signal having a high voltage is supplied to the first input terminal 310, to allow the second driver 304 and the first node N1 to be electrically coupled to each other. To this end, the fourth transistor M34 is formed as an NMOS transistor.

Figure 14:
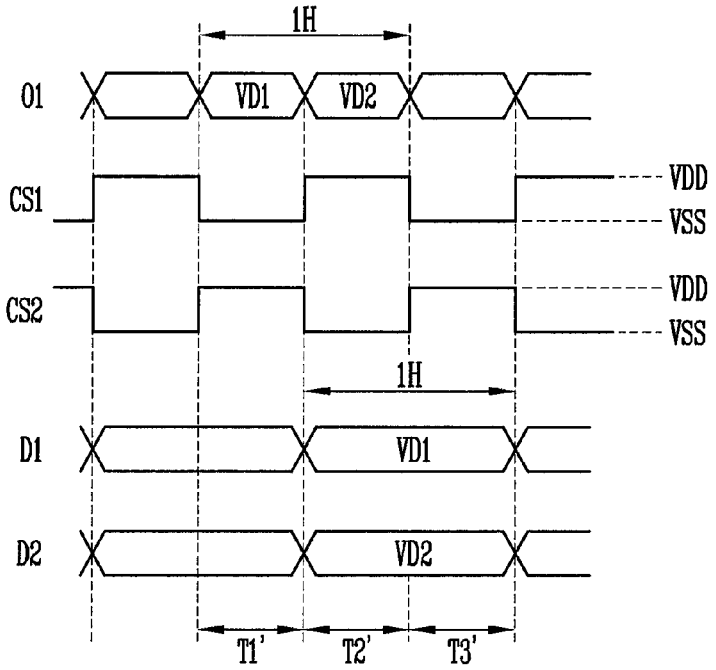
FIG. 14 is a waveform diagram illustrating operating processes of the division units shown in FIGS. 12 and 13.

Meanwhile, the first and second control signals CS1 and CS2, as shown in FIG. 14, are supplied to have phases opposite to each other. That is, the second control signal CS2 is set to the low voltage (or high voltage) during a period in which the first control signal CS1 is set to the high voltage (or low voltage).

The second driver 304 controls a voltage to be supplied to the first node N1, corresponding to the voltage of the second node N2. To this end, the second driver 304 includes a fifth transistor M35, a sixth transistor M36 and a second capacitor C32.

The fifth transistor M35 is coupled between the first power source VDD and the first driver 302. A gate electrode of the fifth transistor M35 is coupled to the second node N2. The fifth transistor M35 controls the coupling between the first power source VDD and the first driver 302, corresponding to the voltage of the second node N2. To this end, the fifth transistor M35 is formed as a PMOS transistor.

The sixth transistor M36 is coupled between the first driver 302 and the second power source VSS. A gate electrode of the sixth transistor M36 is coupled to the second node N2. The sixth transistor M36 controls the coupling between the second power source VSS and the first driver 302, corresponding to the voltage of the second node N2. To this end, the sixth transistor M36 is formed as an NMOS transistor.

The second capacitor C32 is coupled between the second node N2 and the second power source VSS. The second capacitor C32 stores the voltage of the second node N2.

The third driver 306 controls the coupling between the first output line O1 and the second node N2, corresponding to the control signals supplied to the first and second input terminals 310 and 320. To this end, the third driver 306 includes a seventh transistor M37 and an eighth transistor M38.

The seventh transistor M37 is coupled between the first output line O1 and the second node N2. A gate electrode of the seventh transistor M37 is coupled to the first input terminal 310. The seventh transistor M37 is turned on when the first control signal CS1 having the low voltage is supplied to the first input terminal 310, to allow the first output line O1 and the second node N2 to be electrically coupled to each other. To this end, the seventh transistor M37 is formed as a PMOS transistor.

The eighth transistor M38 is coupled between the first output line O1 and the second node N2. A gate electrode of the eighth transistor M38 is coupled to the second input terminal 320. The eighth transistor M38 is turned on when the second control signal CS2 having the high voltage is supplied to the second input terminal 320, to allow the first output line O1 and the second node N2 to be electrically coupled to each other. To this end, the eighth transistor M38 is formed as an NMOS transistor.

Figure 13:
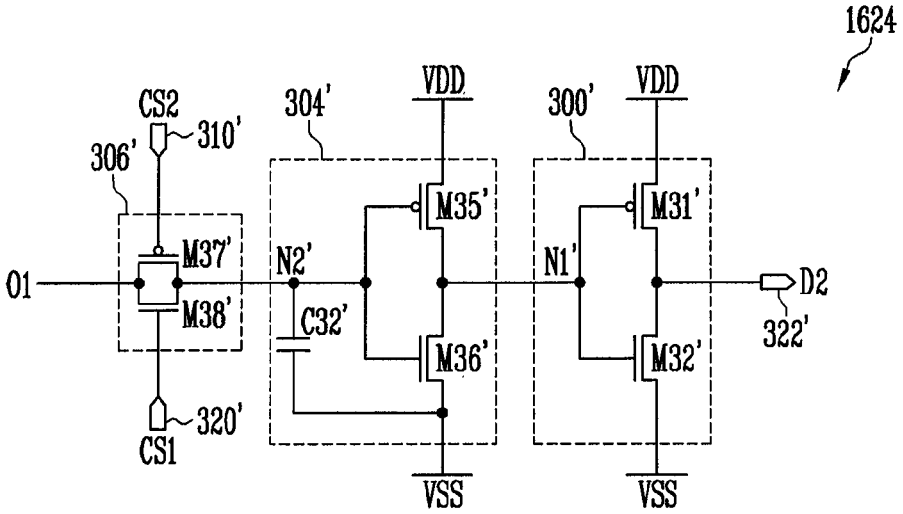
FIG. 13 is a circuit diagram illustrating still another embodiment of the second division unit shown in FIG. 2A.

FIG. 13 is a circuit diagram illustrating still another embodiment of the second division unit shown in FIG. 2A. In FIG. 13, the second division unit 1624 is configured using PMOS and NMOS transistors.

Referring to FIG. 13, the second division unit 1624 according to this embodiment includes an output unit 300', a first driver 304' and a second driver 306'. The output unit 300' and the first driver 304' are driven as inverters, and the second driver 306' performs a function of transmitting data (e.g., data signals).

The output unit 300' supplies the voltage of first or second power source VDD or VSS to an output terminal 322', corresponding to a voltage of a first node N1'. To this end, the output unit 300' includes a first transistor M31' and a second transistor M32'.

The first transistor M31' is coupled between the first power source VDD and the output terminal 322'. A gate electrode of the first transistor M31' is coupled to the first node N1'. The first transistor M31' controls the coupling between the first power source VDD and the output terminal 322', corresponding to the voltage of the first node N1'. To this end, the first transistor M31' is formed as a PMOS transistor.

The second transistor M32' is coupled between the output terminal 322' and the second power source VSS. A gate electrode of the second transistor M32' is coupled to the first node N1'. The second transistor M32' controls the coupling between the second power source VSS and the output terminal 322', corresponding to the voltage of the first node N1'. To this end, the second transistor M32' is formed as an NMOS transistor.

The first driver 304' controls the voltage of the first node N1', corresponding to a voltage of a second node N2'. To this end, the second driver 304' includes a fifth transistor M35', a sixth transistor M36' and a second capacitor C32'.

The fifth transistor M35' is coupled between the first power source VDD, and the first node N1'. A gate electrode of the fifth transistor M35' is coupled to the second node N2'. The fifth transistor M35' controls the coupling between the first power source VDD and the first node N1', corresponding to the voltage of the second node N2'. To this end, the fifth transistor M35' is formed as a PMOS transistor.

The sixth transistor M36' is coupled between the first node N1' and the second power source VSS. A gate electrode of the sixth transistor M36' is coupled to the second node N2'. The sixth transistor M36' controls the coupling between the second power source VSS and the first node N1', corresponding to the voltage of the second node N2'. To this end, the sixth transistor M36' is formed as an NMOS transistor.

The second capacitor C32' is coupled between the second node N2' and the second power source VSS. The second capacitor C32' stores the voltage of the second node N2'.

Meanwhile, in FIG. 13, the transistors and the capacitor, included in the first driver 304', have been named as the fifth transistor M35', the sixth transistor M36' and the second capacitor C32', respectively, so that FIG. 13 can be easily compared with FIG. 12. However, in consideration of transistors actually included in the first driver, the fifth transistor M35', the sixth transistor M36' and the second capacitor C32' may be referred to as a third transistor, a fourth transistor and a first capacitor, respectively. In this case, a seventh transistor M37' and an eighth transistor M38' may be referred to as a fifth transistor and a sixth transistor, respectively.

The second driver 306' controls the voltage of the second node N2', corresponding to a data signal supplied to a first output line O1. To this end, the second driver 306' includes the seventh transistor M37' and the eighth transistor M38'.

The seventh transistor M37' is coupled between the first output line O1 and the second node N2'. A gate electrode of the seventh transistor M37' is coupled to the first input terminal 310'. The seventh transistor M37' is turned on when the second control signal (low voltage) CS2 is supplied to the first input terminal 310', to allow the first output line O1 and the second node N2' to be electrically coupled to each other. To this end, the seventh transistor M37' is formed as a PMOS transistor.

The eighth transistor M38' is coupled between the first output line O1 and the second node N2'. A gate electrode of the eighth transistor M38' is coupled to the second input terminal 320'. The eighth transistor M38' is turned on when the first control signal (e.g., high voltage or a logic high signal) CS1 is supplied to the second input terminal 320', to allow the first output line O1 and the second node N2' to be electrically coupled to each other. To this end, the eighth transistor M38' is formed as an NMOS transistor.

FIG. 14 is a waveform diagram illustrating operating processes of the division units shown in FIGS. 12 and 13.

The operating process of the first division unit will be described in conjunction with FIGS. 12 and 14. First, the data driver 120 sequentially supplies two non-reversed data signals VD1 and VD2 to the first output line O1 during one horizontal period 1H. Here, a primary data signal VD1 is supplied during a low period of the first control signal CS1 and a high period of the second control signal CS2, and a secondary data signal VD2 is supplied during a high period of the first control signal CS1 and a low period of the second control signal CS2.

The first control signal CS1 of the low voltage and the second control signal CS2 of the high voltage are supplied during a first period T1'. When the first control signal CS1 of the low voltage is supplied, the seventh transistor M37 is turned on. When the second control signal CS2 of the high voltage is supplied, the eighth transistor M38 is turned on.

When the seventh and eighth transistors M37 and M38 are turned on, the primary data signal VD1 is supplied from the first output line O1 to the second node N2. Here, the primary data signal VD1 supplied to the second node N2 is supplied to the second node N2 via the seventh and eighth transistors M37 and M38 respectively formed as NMOS and PMOS transistors. Hence, the primary data signal VD1 is stably supplied without any voltage loss.

When the primary data signal VD1 is set to the high voltage, the sixth transistor M36 is turned on. When the sixth transistor M36 is turned on, the voltage of the second power source VSS is supplied to the first driver 302. The high voltage supplied to the second node N2 is stored in the second capacitor C32.

The first control signal CS1 of the high voltage and the second control signal CS2 of the low voltage are supplied during a second period T2' When the first control signal CS1 of the high voltage (e.g., a logic high signal) is supplied, the fourth transistor M34 is turned on. When the second control signal CS2 of the low voltage is supplied, the third transistor M33 is turned on.

When the third and fourth transistors M33 and M34 are turned on, the voltage of the second power source VSS is supplied to the first node N1. Here, the voltage of the second power source VSS, supplied to the first node N1, is supplied via the third and fourth transistors M33 and M34 respectively formed as NMOS and PMOS transistors. Hence, the voltage of the second power source VSS can be supplied without any voltage loss.

When the voltage of the second power source VSS is supplied to the first node N1, the first transistor M31 is turned on. When the first transistor M31 is turned on, the voltage of the first power source VDD is supplied as a data signal to the first data line D1 via the output terminal 322.

When the primary data signal VD1 is set to the low voltage, the fifth transistor M35 is turned on. When the fifth transistor M35 is turned on, the voltage of the first power source VDD is supplied to the first driver 302. The low voltage supplied to the second node N2 is stored in the second capacitor C32.

The first control signal CS1 of the high voltage and the second control signal CS2 of the low voltage are supplied during the second period T2'. When the first control signal CS1 of the high voltage is supplied, the fourth transistor M34 is turned on. When the second control signal CS2 of the low voltage is supplied, the third transistor M33 is turned on.

When the third and fourth transistors M33 and M34 are turned on, the voltage of the first power source VDD is supplied to the first node N1. When the voltage of the first power source VDD is supplied to the first node N1, the second transistor M32 is turned on. When the second transistor M32 is turned on, the voltage of the second power source VSS is supplied as a data signal to the first data line D1 via the output terminal 322.

Subsequently, during a third period T3', the output unit 300 supplies the voltage of the first or second power source VDD or VSS as a data signal to the first data line D1, corresponding to the voltage stored in the first capacitor C31.

As described above, the first division unit 1622 according to this embodiment receives the primary data signal VD1 during a 112H period, and supplies the received primary data signal VD1 as a data signal to the first data line D1 during one horizontal period 1H.

The operating process of the second division unit will be described in conjunction with FIGS. 13 and 14. First, the first control signal CS1 of the high voltage (e.g., a logic high signal) and the second control signal CS2 of the low voltage (e.g., a logic low signal) are supplied during the second period T2'. When the first control signal CS1 of the high voltage is supplied, the eighth transistor M38' is turned on.

When the second control signal CS2 of the low voltage is supplied, the seventh transistor M37' is turned on.

When the seventh and eighth transistors M37' and M38' are turned on, the secondary data signal VD2 is supplied from the first output line O1 to the second node N2'.

Here, when the secondary data signal VD2 is set to the high voltage, the sixth transistor M36' is turned on. When the sixth transistor M36' is turned on, the voltage of the second power source VSS is supplied to the first node N1'. When the voltage of the second power source VSS is supplied to the first node N1', the first transistor M31' is turned on. When the first transistor M31' is turned on, the voltage of the first power source VDD is supplied as a data signal to the second data line D2 via the output terminal 322'.

When the secondary data signal VD2 is set to the low voltage, the fifth transistor M35' is turned on. When the fifth transistor M35' is turned on, the voltage of the first power source VDD is supplied to the first node N1'. When the voltage of the first power source VDD is supplied to the first node N1', the second transistor M32' is turned on. When the second transistor M32' is turned on, the voltage of the second power source VSS is supplied as a data signal to the second data line D2 via the output terminal 322'.

Subsequently, during the third period T3', the voltage of the first node N1' is maintained equally to that in the second period T2'. Thus, during the third period T3', the output unit 300 supplies a voltage equal to that in the second period T2' as a data signal to the second data line D2.

As described above, the second division unit 1624 according to this embodiment receives the secondary data signal VD2 during a ½H period, and supplies the received secondary data signal VD2 as a data signal to the second data line D2 during one horizontal period 1H.

Meanwhile, the division units 1622 and 1624 of FIGS. 12 and 13 are applied to the data divider 162 coupled to the two data lines.

Figure 15:
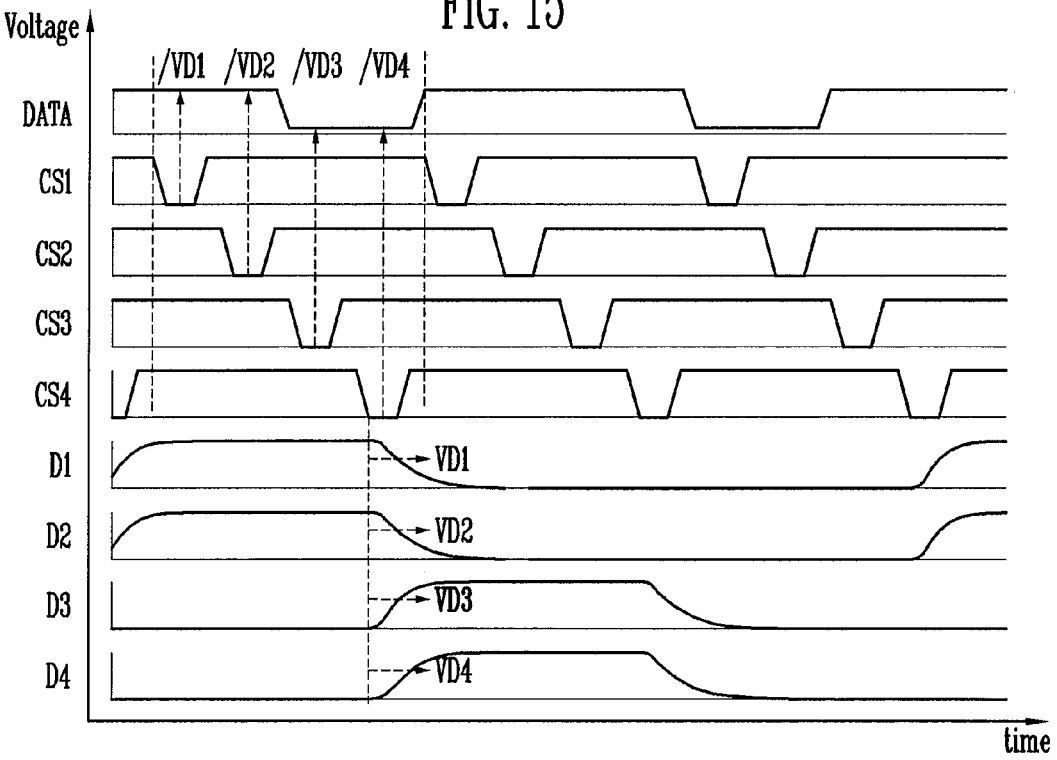
FIG. 15 is a graph illustrating a simulation result when four data signals are supplied from the data divider.

FIG. 15 is a graph illustrating a simulation result when four data signals are supplied from the data divider.

Referring to FIG. 15, the reversed data signals /VD1 to /VD4 are sequentially supplied from the data driver 120, corresponding to the first to fourth control signals CS1 to CS4 sequentially supplied from the control signal generator 170.

The data signals VD1 to VD4 are concurrently (e.g., simultaneously) output to the data lines D1 to D4 during one horizontal period 1H from the time when the fourth control signal CS4 is supplied. That is, in the described embodiment of the present invention, the reversed data signals /VD1 to VD4 sequentially supplied during a 1/iH period are reversed, so that the data signals VD1 to VD4 can be stably supplied to the data lines D1 to D4 during the 1H period.

By way of summation and review, an organic light emitting display is driven by an analog or digital driving method. In the analog driving method, a gray scale (e.g., gray levels) is implemented using a voltage difference. In the digital driving method, a gray scale (e.g., gray levels) is implemented using a time difference.

In the analog driving method, different data voltages are respectively applied to pixels, thereby implementing gray levels. That is, in the analog driving method, a data voltage corresponding to each gray level is generated, and the luminance of the pixels is controlled corresponding to the data voltage. In this case, data voltages of a plurality of levels corresponding to the number of gray levels are generated. However, in the analog driving method, although the same data voltage is supplied, by characteristic variations of the pixels, a luminance variation occurs. Therefore, it is difficult to express an exact gray scale (e.g., exact gray levels).

On the other hand, in the digital driving method, the emission and non-emission of each pixel, i.e., the display period of each pixel is controlled, thereby implementing a gray scale (e.g., gray levels). In the digital driving method, it is possible to overcome the difficulty in implementing an exact gray scale, which difficulty occurs in the organic light emitting display driven by the analog driving method. Accordingly, the digital driving method in which gray levels are expressed by controlling the emission time of each pixel has recently been widely applied.

Meanwhile, in the organic light emitting display, there has been proposed a structure in which a demultiplexer (hereinafter, referred to as a "DEMUX") is added to be coupled to each output line of a data driver. The DEMUX time-divisionally supplies a plurality of data signal respectively supplied to the output lines to a plurality of data lines. That is, the DEMUX transmits, to a plurality of data lines, data signals supplied to one output line, and accordingly, it is possible to reduce or minimize the number of output lines of the data driver. However, when the DEMUX is used, the time when the data signal is supplied to each data line is reduced, thereby deteriorating display quality.

For example, in the digital driving method, one frame is divided into a plurality of subframes. When the one frame is divided into the plurality of subframes as described above, one horizontal period 1H is decreased. When the DEMUX is used, the one horizontal period 1H is additionally divided. Hence, there occurs a case where the driving of the organic light emitting display is very difficult or impossible.

In the organic light emitting display according to one embodiment of the present invention, i data signals supplied from the data driver during a 1/iH period are supplied to i data lines during the 1H period. In one embodiment of the present invention, the data signal is supplied to each data line during the 1H period, using the data divider, and accordingly, it is possible to sufficiently secure the charging time of the data signal, thereby improving display quality.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. An organic light emitting display comprising:

pixels at areas defined by scan lines and data lines;

a data driver configured to sequentially supply i (i is a natural number greater than or equal to 2) data signals to each of output lines during one horizontal period;

a plurality of data dividers respectively coupled to the output lines, the plurality of data dividers being configured to supply the i data signals to i data lines from among the data lines; and a control signal generator configured to sequentially supply i control signals to the data dividers, corresponding to the i data signals, wherein the data dividers are configured to supply a corresponding one of the data signals to each of the data lines during the one horizontal period, wherein the data driver is configured to reverse or not reverse a first data signal corresponding to emission of a corresponding pixel of the pixels or a second data signal corresponding to non-emission of the corresponding pixel, and to supply the first or second data signal as the one of the data signals, wherein the data divider includes i division units respectively coupled to the i data lines, wherein the division units include a second division unit configured to receive an i-th data signal in the one horizontal period, and one or more first division units configured to receive other data signals except the i-th data signal in the one horizontal period, each of the one or more first division units being configured with a circuit different from that of the second division unit, and wherein each of the one or more first division units comprises:

an output unit configured to supply a voltage of a first or second power source to an output terminal coupled to a corresponding one of the data lines, corresponding to voltages of first and second nodes;

a first driver coupled to a second input terminal, the first driver being configured to control a coupling between the output unit and the first and second nodes;

a second driver coupled to the first power source and a third power source, the second driver being configured to control the voltage of the first node, corresponding to a first input terminal, the second input terminal and a third node;

a third driver coupled to the first and third power sources, the third driver being configured to control a voltage of the third node, corresponding to an output line, the first input terminal and a third input terminal; and a fourth driver coupled to the first and third power sources, the fourth driver being configured to control the voltage of the second node, corresponding to the output line, the first input terminal and the second input terminal.

2. The organic light emitting display of claim 1, wherein a control signal overlapped with a data signal is supplied to the first input terminal, a control signal overlapped with the i-th data signal is supplied to the second input terminal, and a control signal supplied prior to the control signal supplied to the first input terminal is supplied to the third input terminal.

3. The organic light emitting display of claim 1, wherein the first driver comprises:

a third transistor coupled between the first node and a gate electrode of a first transistor, the third transistor having a gate electrode coupled to the second input terminal; and a fourth transistor coupled between the second node and the gate electrode of a second transistor, the fourth transistor having a gate electrode coupled to the second input terminal.

4. The organic light emitting display of claim 1, wherein the output unit comprises:

a first transistor coupled between the first power source and the output terminal, the first transistor having a gate electrode coupled to the first node via the first driver;

a second transistor coupled between the output terminal and the second power source, the second transistor having a gate electrode coupled to the second node via the first driver;

a first capacitor coupled between the first power source and the gate electrode of the first transistor; and a second capacitor coupled between the output terminal and the gate electrode of the second transistor.

5. The organic light emitting display of claim 4, wherein the second driver comprises:

a fifth transistor coupled between the first power source and a sixth transistor, the fifth transistor having a gate electrode coupled to the second input terminal;

the sixth transistor coupled between the fifth transistor and the first node, the sixth transistor having a gate electrode coupled to a fourth node;

a seventh transistor coupled between the first node and the third power source, the seventh transistor having a gate electrode coupled to the first input terminal;

an eighth transistor coupled between the third and fourth nodes, the eighth transistor having a gate electrode coupled to the first input terminal;

a third capacitor coupled between the first power source and the fourth node; and a fourth capacitor coupled between the first node and the third power source, the fourth capacitor having a capacity higher than that of the first capacitor.

6. The organic light emitting display of claim 5, wherein the third driver comprises:

a ninth transistor coupled between the first power source and the third node, the ninth transistor having a gate electrode coupled to a fifth node;

a tenth transistor coupled between the third node and the third power source, the tenth transistor having a gate electrode coupled to the third input terminal;

an eleventh transistor coupled between the first power source and the fifth node, the eleventh transistor having a gate electrode coupled to the third input terminal;

a twelfth transistor coupled between the output line and the fifth node, the twelfth transistor having a gate electrode coupled to the first input terminal;

a fifth capacitor coupled between the third node and the third power source, the fifth capacitor having a capacity higher than that of the third capacitor; and a sixth capacitor coupled between the first power source and the fifth node.

7. The organic light emitting display of claim 4, wherein the fourth driver comprises:

a thirteenth transistor coupled between the first power source and a fourteenth transistor, the thirteenth transistor having a gate electrode coupled to the second input terminal;

the fourteenth transistor coupled between the thirteenth transistor and the second node, the fourteenth transistor having a gate electrode coupled to a sixth node;

a fifteenth transistor coupled between the second node and the third power source, the fifteenth transistor having a gate electrode coupled to the first input terminal;

a sixteenth transistor coupled between the output line and the sixth node, the sixteenth transistor having a gate electrode coupled to the first input terminal;

a seventh capacitor coupled between the second node and the third power source, the seventh capacitor having a capacity higher than that of the second capacitor; and an eighth capacitor coupled between the first power source and the sixth node.

8. An organic light emitting display comprising:

pixels at areas defined by scan lines and data lines;

a data driver configured to sequentially supply i (i is a natural number greater than or equal to 2) data signals to each of output lines during one horizontal period;

a plurality of data dividers respectively coupled to the output lines, the plurality of data dividers being configured to supply the i data signals to i data lines from among the data lines; and a control signal generator configured to sequentially supply i control signals to the data dividers, corresponding to the i data signals, wherein the data dividers are configured to supply a corresponding one of the data signals to each of the data lines during the one horizontal period, wherein the data driver is configured to reverse or not reverse a first data signal corresponding to emission of a corresponding pixel of the pixels or a second data signal corresponding to non-emission of the corresponding pixel, and to supply the first or second data signal as the one of the data signals, wherein the data divider includes i division units respectively coupled to the i data lines, wherein the division units include a second division unit configured to receive an i-th data signal in the one horizontal period, and one or more first division units configured to receive other data signals except the i-th data signal in the one horizontal period, each of the one or more first division units being configured with a circuit different from that of the second division unit, and wherein the second division unit comprises:

an output unit configured to supply a voltage of a first or second power source to an output terminal coupled to one of the data lines, corresponding to voltages of first and second nodes;

a first driver coupled to a second input terminal, the first driver controlling a coupling between the output unit and the first and second nodes; and a second driver coupled to the first power source and a third power source, the second driver being configured to control the voltages of the first and second nodes, corresponding to an output line, a first input terminal and the second input terminal.

9. The organic light emitting display of claim 8, wherein a control signal overlapped with a data signal is supplied to the second input terminal, and a control signal supplied prior to the control signal supplied to the second input terminal is supplied to the first input terminal.

10. The organic light emitting display of claim 8, wherein the output unit comprises:

a first transistor coupled between the first power source and the output terminal, the first transistor having a gate electrode coupled to the first node via the first driver;

a second transistor coupled between the output terminal and the second power source, the second transistor having a gate electrode coupled to the second node via the first driver;

a first capacitor coupled between the first power source and the gate electrode of the first transistor; and a second capacitor coupled between the output terminal and the gate electrode of the second transistor.

11. The organic light emitting display of claim 10, wherein the second driver comprises:

a fifth transistor coupled between the first power source and the second node, the fifth transistor having a gate electrode coupled to the first node;

a sixth transistor coupled between the second node and the third power source, the sixth transistor having a gate electrode coupled to the first input terminal;

a seventh transistor coupled between the first power source and the first node, the seventh transistor having a gate electrode coupled to the first input terminal;

an eighth transistor coupled between the output line and the first node, the eighth transistor having a gate electrode coupled to the second input terminal;

a third capacitor coupled between the second node and the third power source, the third capacitor having a capacity higher than that of the second capacitor; and a fourth capacitor coupled between the first power source and the first node.

12. The organic light emitting display of claim 8, wherein the first driver comprises:

a third transistor coupled between the first node and a gate electrode of a first transistor, the third transistor having a gate electrode coupled to the second input terminal; and a fourth transistor coupled between the second node and the gate electrode of a second transistor, the fourth transistor having a gate electrode coupled to the second input terminal.

13. An organic light emitting display comprising:

pixels at areas defined by scan lines and data lines;

a data driver configured to sequentially supply i (i is a natural number greater than or equal to 2) data signals to each of output lines during one horizontal period;

a plurality of data dividers respectively coupled to the output lines, the plurality of data dividers being configured to supply the i data signals to i data lines from among the data lines; and a control signal generator configured to sequentially supply i control signals to the data dividers, corresponding to the i data signals, wherein the data dividers are configured to supply a corresponding one of the data signals to each of the data lines during the one horizontal period, wherein the data divider includes i division units respectively coupled to the i data lines, wherein the division units include a second division unit configured to receive an i-th data signal in the one horizontal period, and one or more first division units configured to receive other data signals except the i-th data signal in the one horizontal period, each of the one or more first division units being configured with a circuit different from that of the second division unit, and wherein each of the one or more first division units comprises:

an output unit configured to supply a voltage of a first power source or a second power source set to a voltage lower than that of the first power source to an output terminal coupled to one of the data lines, corresponding to a voltage of a first node;

a second driver configured to output the voltage of the first or second power source, corresponding to a voltage of a second node;

a first driver coupled to first and second input terminals, the first driver being configured to control a coupling between the second driver and the first node; and a third driver coupled to the first and second input terminals, the third driver being configured to control a coupling between an output line and the second node.

14. The organic light emitting display of claim 13, wherein a first control signal is supplied to the first input terminal, and a second control signal having a phase reversed with respect to the first control signal is supplied to the second input terminal.

15. The organic light emitting display of claim 13, wherein the output unit comprises: a first PMOS transistor coupled between the first power source and the output terminal, the first PMOS transistor having a gate electrode coupled to the first node; a second NMOS transistor coupled between the output terminal and the second power source, the second NMOS transistor having a gate electrode coupled to the first node; and a first capacitor coupled between the first node and the second power source, wherein the first driver comprises: a third PMOS transistor coupled between the second driver and the first node, the third PMOS transistor having a gate electrode coupled to the second input terminal; and a fourth NMOS transistor coupled between the second driver and the first node, the fourth NMOS transistor having a gate electrode coupled to the first input terminal, wherein the second driver comprises: a fifth PMOS transistor coupled between the first power source and the first driver, the fifth PMOS transistor having a gate electrode coupled to the second node; a sixth NMOS transistor coupled between the first driver and the second power source, the sixth NMOS transistor having a gate electrode coupled to the second node; and a second capacitor coupled between the second node and the second power source, and wherein the third driver comprises: a seventh PMOS transistor coupled between the output line and the second node, the seventh PMOS transistor having a gate electrode coupled to the first input terminal; and an eighth NMOS transistor coupled between the output line and the second node, the eighth NMOS transistor having a gate electrode coupled to the second input terminal.

16. An organic light emitting display comprising:

pixels at areas defined by scan lines and data lines;

a data driver configured to sequentially supply i (i is a natural number greater than or equal to 2) data signals to each of output lines during one horizontal period;

a plurality of data dividers respectively coupled to the output lines, the plurality of data dividers being configured to supply the i data signals to i data lines from among the data lines; and a control signal generator configured to sequentially supply i control signals to the data dividers, corresponding to the i data signals, wherein the data dividers are configured to supply a corresponding one of the data signals to each of the data lines during the one horizontal period, wherein the data divider includes i division units respectively coupled to the i data lines, wherein the division units include a second division unit configured to receive an i-th data signal in the one horizontal period, and one or more first division units configured to receive other data signals except the i-th data signal in the one horizontal period, each of the first division unit being configured with a circuit different from that of the second division unit, and wherein the second division unit comprises:

an output unit configured to supply a voltage of a first power source or a second power source set to a voltage lower than that of the first power source to an output terminal coupled to one of the data lines, corresponding to a voltage of a first node;

a first driver configured to supply the voltage of the first or second power source to the first node, corresponding to a voltage of a second node; and a second driver coupled between first and second input terminals, the second driver controlling a coupling between an output line and the second node.

17. The organic light emitting display of claim 16, wherein the output unit comprises: a first PMOS transistor coupled between the first power source and the output terminal, the first PMOS transistor having a gate electrode coupled to the first node; and a second NMOS transistor coupled between the output terminal and the second power source, the second NMOS transistor having a gate electrode coupled to the first node, wherein the first driver comprises: a fifth PMOS transistor coupled between the first power source and the first node, the fifth PMOS transistor having a gate electrode coupled to the second node; a sixth NMOS transistor coupled between the first node and the second power source, the sixth NMOS transistor having a gate electrode coupled to the second node; and a second capacitor coupled between the second node and the second power source, and wherein the second driver comprises: a seventh PMOS transistor coupled between the output line and the second node, the seventh PMOS transistor having a gate electrode coupled to the first input terminal; and an eighth NMOS transistor coupled between the output line and the second node, the eighth NMOS transistor having a gate electrode coupled to the second input terminal.

* * * * *